US006482768B1

(12) United States Patent
Yoshinari et al.

(10) Patent No.: US 6,482,768 B1
(45) Date of Patent: Nov. 19, 2002

(54) LASER THERMAL TRANSFER MATERIAL

(75) Inventors: Shinichi Yoshinari, Shizuoka-ken (JP); Akira Hatakeyama, Shizuoka-ken (JP); Tamotsu Suzuki, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 57 days.

(21) Appl. No.: 09/629,801

(22) Filed: Jul. 31, 2000

(30) Foreign Application Priority Data

Jul. 30, 1999 (JP) ..... 11-217947
Jul. 30, 1999 (JP) ..... 11-217948

(51) Int. Cl.[7] ..... B41M 5/035; B41M 5/38
(52) U.S. Cl. ..... 503/227; 428/913; 428/914
(58) Field of Search ..... 8/471; 503/227; 428/913, 914

(56) References Cited

U.S. PATENT DOCUMENTS 5,037,799 A * 8/1991 Chapman et al. ..... 503/227
5,747,199 A * 5/1998 Roberts et al. ..... 430/7

FOREIGN PATENT DOCUMENTS

| | | |
|---|---|---|
| JP | 6-175361 | 6/1994 |
| JP | 10-268570 | 10/1998 |
| JP | 10-268571 | 10/1998 |
| JP | 10-268572 | 10/1998 |
| JP | 10-292144 | 11/1998 |
| JP | 10-312088 | 11/1998 |
| JP | 11-65172 | 3/1999 |

* cited by examiner

*Primary Examiner*—Bruce H. Hess
(74) *Attorney, Agent, or Firm*—Sughrue Mion, PLLC

(57) ABSTRACT

A laser thermal transfer material making it possible to form an image having a good hue without a drop in density based on thermal decomposition of a coloring agent even in image-recording by laser thermal transfer. A laser thermal transfer material having a light-to-heat conversion layer and an image forming layer on a support, the image forming layer having a compound represented by the following general formula (1) or (2).

general formula (1)

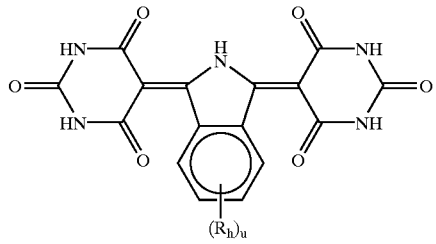

general formula (2)

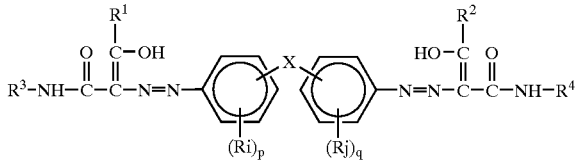

16 Claims, No Drawings

LASER THERMAL TRANSFER MATERIAL

BACKGROUND OF THE INVENTION

1. Field of the Invention

The present invention relates to a laser thermal transfer material in which thermal transfer of an image is performed by irradiation of a laser. More particularly, the present invention relates to a laser thermal transfer material in which a color proof (DDCP: direct digital color proof) or a masking image in the field of printing is formed by irradiation of a laser on the basis of digital image signals.

2. Description of the Related Art

Hitherto, there has been known a thermal transfer recording technique in which a thermal transfer image receiving material and a thermal transfer material having a support on which a color material layer is provided are laminated. The color material layer contains therein a thermally soluble color material layer or a thermally sublimating dye. The laminated thermal transfer image receiving material and thermal transfer material are heated imagewise from the thermal transfer material side by using a heating device which is controlled by electric signals, such as a thermal head, or an electrically conductive head to thereby transfer and record an image onto the thermal transfer image receiving material.

Such a thermal transfer recording technique has characteristics of low noise, being maintenance free, having low manufacturing cost, facilitating coloring, and being capable of digital recording. This technique is therefore utilized in multiple fields such as in various types of printers, recorders, facsimiles, and computer terminals.

On the other hand, in recent years, in the medical and printing fields, there has been a demand for recording systems which have a high resolution and enable high speed recording as well as enabling image processing, i.e., recording systems which enable so called digital recording. However, in the thermal transfer recording system in which a heating device such as a thermal head or an electrically conductive head is used, image resolution of this system is constrained by the layout density of the heating elements of a head. Further, it is difficult to control the heating temperature of the heating elements at a high speed, due to the characteristics of the heating elements. Accordingly, it is difficult to obtain a high resolution image at a high speed.

Thus, one system capable of providing an image with high resolution at a high speed is a laser recording technology which utilizes a light-to-heat conversion action due to the irradiation of a laser. Recently this system has attracted much attention and is being manufactured as a finished product.

In an image forming system using this technology, in particular, the single mode laser is generally used from the standpoint of attaining highly accurate and finely focused beams, and due to such beam quality, a high resolution image is obtained. Moreover, recording speed is also improved such that an image is formed more speedily than in any conventional recording system which uses a heating device such as a thermal head.

However, in laser recording, laser light having a relatively high energy is used in the state that the focus beam diameter of the laser is converged to about 10 $\mu$m. Thus, the laser light is highly efficiently converted to heat, so as to give a far higher heat energy than heating devices such as a thermal head used in thermal recording. Therefore, the temperature of the area irradiated with the laser locally reaches a very high temperature so that a coloring agent (pigment) contained in an image forming layer in this area decomposes thermally. The coloring agent decomposes thermally so that its hue is lost. Thus, an image having a desired density is not transferred onto an image receiving layer on which the coloring agent is to be transferred, thereby resulting in a drop in the density of the formed image.

Furthermore, the coloring material used as the coloring agent is generally a pigment or the like. However, if many pigments are thermally decomposed, they emit a material harmful to human bodies. Accordingly, in recent years, techniques for preventing or reducing the harmful materials have been sought in compliance with a demand for improving working environment or safety.

Incidentally, JP-A Nos. 6-175361 and 10-292144 disclose techniques using an isoindoline pigment with which a sufficient density can be obtained and has excellent dispersability and color-reproducibility. However, the above-mentioned publications do not state that the pigment is used in any high-temperature treating system. Moreover, such a pigment as above has not been used in any thermal transfer material up to the present. The pigment has not been used to prevent a drop in image density accompanying an improvement in heat-resistance.

JP-A Nos. 10-312088 and 10-292144 disclose techniques using C. I. Pigment Yellow or the like, which has excellent dispersability, light resistance and color-reproducibility. Furthermore, JP-A Nos. 10-268570, 10-268571, 10-268572 and 11-65172 state that the above-mentioned pigment is used as a coloring agent of a developer for developing electrostatic latent images, and has excellent heat resistance. However, such a pigment has not been used in any thermal transfer material up to now. It has not been so far made clear whether harmful materials are generated or whether the pigment generates harmful materials and has heat resistance sufficient to avoid thermal decomposition, in particular, in a case in which the pigment is used as a coloring agent of a thermal transfer material through which recording is performed at a very high temperature by converging laser light.

Incidentally, a single mode laser is generally used for laser recording. The laser power thereof is in a relatively low range of about 150 to 200 mW. Therefore, the single mode laser has not reached a satisfactory level with regard to its productivity.

Recently, therefore, a multi-mode semiconductor laser generally having higher power than the single mode laser has been used in order to increase laser power and make laser recording speed high. This multi-mode semiconductor laser has a high power of 1 W or more, thus enabling a considerable increase in laser power of the laser head.

However, there is a problem in that the multi-mode semiconductor laser has difficulties in converging a laser beam in the widthwise direction and thus the laser beam cannot be converged to have a focal beam diameter as low as 20 $\mu$m or less.

Therefore, in fields such as the medical and printing fields, when attempts are made to record a highly accurate image having a sub-scanning pitch of about 10 $\mu$m using the multi-mode semiconductor laser, adjacent beams overlap with each other and overlapping portions are heated excessively, whereby thermal decomposition of coloring agents as described above advances. Thus, a drop in the density of the image is promoted, and/or release of harmful materials is promoted.

Therefore, even if recording is performed using a multi-mode laser having a high power and overlapping adjacent beams as described above, there is demanded a material that is not easily thermally decomposed at high temperatures or a material that does not emit any harmful material even if it is thermally decomposed.

Up to the present, for image-recording using light-to-heat effect resulting from laser radiation, there has not yet been provided any thermal transfer material which has very high heat resistance not causing a coloring agent to be easily thermally decomposed at high temperatures and can give a high-quality image having a high image density. Moreover, there has not yet been provided any thermal transfer material which has high heat resistance, causes neither drop in image density nor image defects, and has such high safety that prevents generation of harmful materials.

SUMMARY OF THE INVENTION

An object of the present invention is to solve the above-mentioned problems in the prior art.

Another object of the present invention is to provide a laser thermal transfer material which does not cause a drop in density based on thermal decomposition of a coloring agent and can form an image having a vivid and good hue even if laser light is used for image-recording by thermal transfer.

A further object of the present invention is to provide a laser thermal transfer material which does not generate any harmful material even if a coloring agent is thermally decomposed by heat upon thermal transfer recording.

A still further object of the present invention is to provide a laser thermal transfer material which can stably form an image having a high image density, no image defects such as transfer unevenness, and a high-quality, with thermal decomposition of a coloring agent being suppressed, even if a laser is used in image-recording by thermal transfer, and further which can prevent any harmful material from being generated.

The inventors have found that the following inventions can attain the above-mentioned objects.

<1> A laser thermal transfer material comprising at least a light-to-heat conversion layer and an image forming layer on a support, said image forming layer comprising at least one compound selected from the group consisting of compounds represented by the following general formulas (1) to (5):

general formula (1)

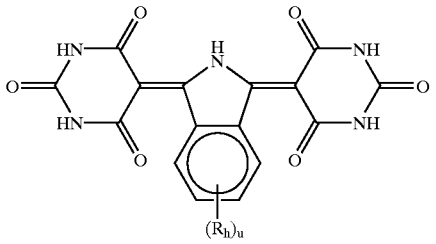

wherein Rh represents a hydrogen atom, an alkyl group having 1–5 carbon atoms, an alkoxy group having 1–5 carbon atoms, a halogen atom, a carboxylate ester group having an alkyl group having 1–5 carbon atoms, or an amide group having an alkyl group having 1–5 carbon atoms; u is an integer of 1–4; and if u is at least two, Rh's may be the same as or different from each other;

general formula (2)

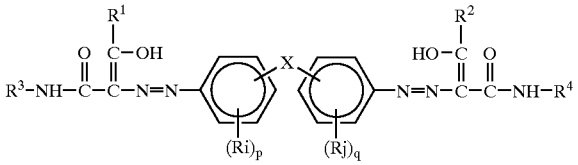

wherein $R^1$ and $R^2$ each independently represents an alkyl group having 1–5 carbon atoms or an alkoxy group having 1–5 carbon atoms; $R^3$ and $R^4$ each independently represents an aromatic group, or a condensed heterocyclic group wherein a heteroring is condensed with an aromatic ring; aromatic groups comprising Ri or Rj are connected to each other through a bivalent connecting group X; Ri and Rj each independently represents a hydrogen atom, an alkyl group having 1–5 carbon atoms, an alkoxy group having 1–5 carbon atoms, or a halogen atom; p and q each independently represents an integer of 1–4; and if p or q is at least 2, Ri's and Rj's may be the same as or different from each other;

general formula (3)

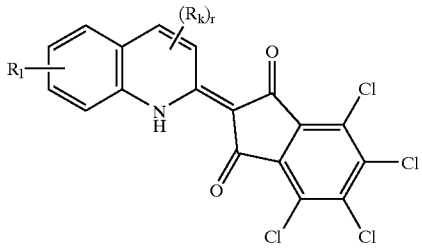

wherein Rk represents a hydrogen atom, an alkyl group having 1–5 carbon atoms or an alkoxy group having 1–5 carbon atoms; r is an integer of 1 or 2; if r is 2, Rk's may be the same or different from each other; and Rl represents a tetrachlorophthaloimide group represented by the following structural formula (b):

structural formula (b)

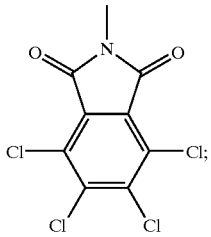

general formula (4)

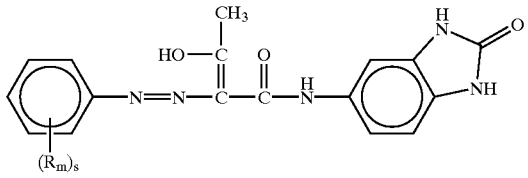

wherein Rm represents an alkoxylcarbonyl group having 2–5 carbon atoms, an alkyl group having 1–5 carbon atoms or an alkoxy group having 1–5 carbon atoms; s is an integer of 1–5; and if s is at least two, Rm's may be the same as or different from each other;

general formula (5)

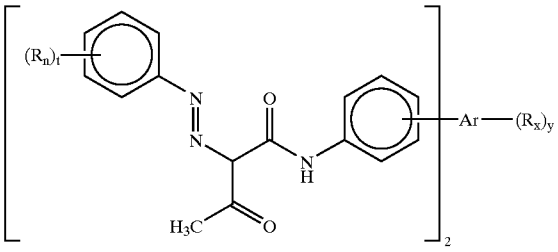

wherein Ar represents an arylene group; Rn represents a hydrogen atom, an alkoxylcarbonyl group having 2–5 carbon atoms, an alkyl group having 1–5 carbon atoms or an alkoxy group having 1–5 carbon atom; t is an integer of 1–5; Rx represents a hydrogen atom, an alkyl group having 1–5 carbon atoms or an alkoxy group having 1–5 carbon atoms; y is an integer of 1–4; and if t or y is at least 2, Rn's or Rx's may be the same as or different from each other.

<2> A laser thermal transfer material comprising at least a light-to-heat conversion layer and an image forming layer on a support, wherein said image forming layer comprises a compound having an isoindoline ring, which is represented by the above-mentioned general formula (1).

<3> A laser thermal transfer material comprising at least a light-to-heat conversion layer and an image forming layer on a support, wherein said image forming layer comprises a disazo compound having a benzimidazolone ring, which is represented by the above-mentioned general formula (2).

In the general formula (2), $R^1$ and $R^2$ each independently represents an alkyl group having 1–5 carbon atoms and preferably 1–4 carbon atoms, or an alkoxy group having 1–5 carbon atoms and preferably 1–4 carbon atoms; $R^3$ and $R^4$ each independently represents an aromatic group, or a condensed heterocyclic group wherein a heteroring is condensed with an aromatic ring, and preferably an benzimidazolone ring group represented by the following structural formula (a); aromatic groups comprising Ri or Rj are connected to each other through a bivalent connecting group X; Ri and Rj each independently represents a hydrogen atom, an alkyl group having 1–5 carbon atoms and preferably 1–4 carbon atoms, an alkoxy group having 1–5 carbon atoms and preferably 1–4 carbon atoms, or a halogen atom; p and q each independently represents an integer of 1–4; and if p or q is at least 2, Ri's and Rj's may be the same as or different from each other;

Structural formual (a)

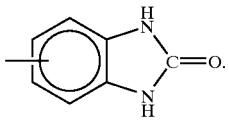

<4> A laser thermal transfer material comprising at least a light-to-heat conversion layer and an image forming layer on a support, wherein said image forming layer comprises a quinophthalone compound represented by the above-mentioned general formula (3).

<5> A laser thermal transfer material comprising at least a light-to-heat conversion layer and an image forming layer on a support, wherein said image forming layer comprises a monoazo compound having a benzimidazolone ring, which is represented by the above-mentioned general formula (4).

<6> A laser thermal transfer material comprising at least a light-to-heat conversion layer and an image forming layer on a support, wherein said image forming layer comprises a condensed azo compound represented by the above-mentioned general formula (5).

<7> A laser thermal transfer material comprising at least a light-to-heat conversion layer and an image forming layer on a support, wherein said image forming layer comprises a compound having an isoindoline ring, which is represented by the above-mentioned general formula (1), and at least one compound selected from the group consisting of compounds represented by the above-mentioned general formulas (2) to (5).

<8> The material according to the above-mentioned <7>, wherein the weight ratio of the content (X) of said compound having the isoindolinone ring, which is represented by the general formula (1) to the total content (Y) of at least one compound selected from said group consisting of compounds represented by the general formulas (2) to (5), in said image forming layer, is from 1:99 to 30:70.

<9> A laser thermal transfer material comprising at least a light-to-heat conversion layer and an image forming layer on a support, wherein said image forming layer comprises a compound represented by the above-mentioned general formula (2).

<10> The material according to the above-mentioned <9>, wherein the compound represented by the general formula (2) is a yellow pigment.

<11> The material according to the above-mentioned <9> or <10>, wherein the material is used in a thermal transfer image receiving material, which further comprises at least an image receiving layer and a cushion layer on the support.

<12> The material according to any one of the above-mentioned <9> to <11>, further comprising a cushion layer between the support and the light-to-heat conversion layer.

<13> A laser thermal transfer material comprising at least a light-to-heat conversion layer and an image forming layer on a support, wherein said image forming layer comprises a compound represented by the following general formula (2);

general formula (2)'

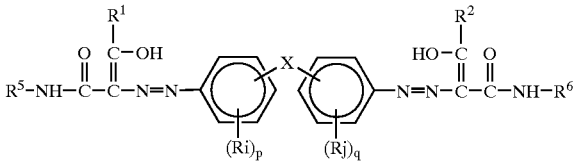

wherein $R^1$ and $R^2$ each independently represents an alkyl group having 1–4 carbon atoms or an alkoxy group having 1–4 carbon atoms; $R^5$ and $R^6$ each independently represents a benzimidazolone ring group represented by the above-mentioned structural formula (a); aromatic groups comprising Ri or Rj are connected to each other through a bivalent connecting group X; Ri and Rj each independently represents a hydrogen atom, an alkyl group having 1–4 carbon atoms, an alkoxy group having 1–4 carbon atoms, or a halogen atom; p and q each independently represents an integer of 1–4; and if p or q is at least 2, Ri's and Rj's may be the same as or different from each other.

<14> The material according to the above-mentioned <13>, wherein the compound represented by the general formula (2) is a yellow pigment.

<15> The material according to the above-mentioned <13> or <14>, wherein the material is used in a thermal transfer image receiving material, which further comprises at least an image receiving layer and a cushion layer on the support.

<16> The material according to any one of the above-mentioned <13> to <15>, further comprising a cushion layer between the support and the light-to-heat conversion layer.

DESCRIPTION OF THE PREFERRED EMBODIMENTS

The laser thermal transfer material of the present invention comprises a pigment having very high heat resistance in its image forming layer. The pigment does not cause a drop in image density even when image recording is effected by a laser.

The laser thermal transfer material of the present invention comprises, as a coloring agent in its image forming layer, apigment which does not generate harmful substances even when the pigment is thermally decomposed, or a pigment which is not easily thermally decomposed even when a laser is used in image recording by thermal transfer.

The laser thermal transfer material of the present invention will be described hereinafter, so as to make clear not only the laser thermal transfer material but also a thermal transfer image receiving material used together with the laser thermal transfer material and a thermal transfer recording method.

Laser Thermal Transfer Material:

The laser thermal transfer material of the present invention (occasionally referred to hereinafter as a "thermal transfer material") may be in any form as long as the thermal transfer material has a function which allows an image to be formed on a thermal transfer image receiving material (to be described later) by thermal transfer. The thermal transfer material may have, for example, a structure wherein at least a light-to-heat conversion layer and an image forming layer are laminated in this order on a support and, if necessary, other layers such as a heat-sensitive peeling layer and a cushion layer are disposed.

Image Forming Layer

The image forming layer is structured so as to comprise at least a pigment as a coloring agent and an amorphous organic high polymer.

The type of pigment used as the coloring agent may be of a single type, or a plurality of types may be used in combination.

In the present invention, as the pigment there may be used a compound represented by the general formula (1), that is, a compound having an isoindoline ring.

general formula (1)

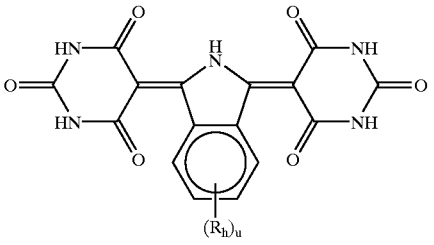

In the formula (1), Rh represents a hydrogen atom, an alkyl group having 1–5 carbon atoms, an alkoxy group having 1–5 carbon atoms, a halogen atom, a carboxylate ester group having an alkyl group having 1–5 carbon atoms, or an amide group having an alkyl group having 1–5 carbon atoms.

Examples of the alkyl group having 1–5 carbon atoms include methyl, ethyl, propyl, butyl, and pentyl groups. Among them, an alkyl group having 1–2 carbon atoms is preferable. Methyl and ethyl groups are especially preferable.

Examples of the alkoxyl group having 1–5 carbon atoms include methoxy, ethoxy, propoxy, butoxy and pentyloxy groups. Among them, an alkoxy group having 1–2 carbon atoms is preferable. Methoxy and ethoxy groups are especially preferable.

Examples of the carboxylate ester having an alkyl group having 1–5 carbon atoms include $—OCOCH_3$, $—OCOC_2H_5$, $—OCOC_3H_7$, $—OCOC_4H_9$, and $—OCOC_5H_{11}$. Preferable is $—OCOCH_3$.

Examples of the amide group having an alkyl group having 1–5 carbon atoms include $—NHCOCH_3$, $—NHCOC_2H_5$, and $—NHCOC_3H_7$.

In the formula (1), u is an integer of 1–4; and if u is at least two, Rh's may be the same as or different from each other.

The compound having an isoindoline ring, which is represented by the general formula (1), has very good heat resistance. Even when thermal recording utilizing heat generated by a light-to-heat conversion effect resulting from laser irradiation, the compound is not thermally decomposed and a high-quality image having a desired density and no image defects such as transfer unevenness can be stably formed. The transfer unevenness referred to herein refers to a phenomenon in which, the time of thermal transfer recording, the transfer density at the central portion of a scanning line of laser light becomes thin, and conversely the transfer density at both end portions of the scanning line becomes thick. The difference between these densities makes its appearance as density unevenness in the formed image.

In the present invention, a compound (pigment) represented by any one of the following general formulas (2) to (5) may be used instead of the compound having an isoindoline ring, which is represented by the general formula (1) and used as a coloring agent.

The following will describe compounds represented by the general formula (2), that is, disazo compounds, and preferably disazo compounds each having a benzimidazolone ring.

general formula (2)

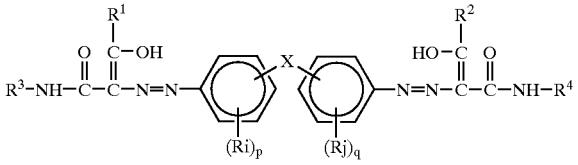

In the formula (2), $R^1$ and $R^2$ each independently represents an alkyl group having 1–5 carbon atoms and preferably 1–4 carbon atoms, or an alkoxy group having 1–5 carbon atoms and preferably 1–4 carbon atoms.

Examples of the alkyl group include methyl, ethyl, n-propyl, isopropyl and butyl groups. Among them, an alkyl group having 1–2 carbon atoms is preferable. Methyl and ethyl groups are especially preferable.

Examples of the alkoxy group include methoxy, ethoxy, propoxy and butoxy groups. Among them, an alkoxy group having 1–2 carbon atoms is preferable. Methoxy and ethoxy groups are especially preferable.

In the formula (2), $R^3$ and $R^4$ each independently represents an aromatic group, or a condensed heterocyclic group wherein a heteroring is condensed with an aromatic ring, and preferably a benzimidazolone ring represented by the structural formula (a) shown below.

The aromatic group and the condensed heterocyclic group may have a substituent.

Examples of the substituent include methyl, ethyl, n-propyl, isopropyl, butyl, methoxy, ethoxy, propoxy and butoxy groups, a halogen atom, and —$SO_3Na$.

Examples of the aromatic group include phenyl and naphthyl groups.

Examples of the condensed heterocyclic group include benzimidazolone ring, benztriazoyl and dioxybenzfuranoyl groups. Among them, a benzimidazolone ring group is preferable.

Either one of $R^3$ and $R^4$ may be a compound substituted with a benzimidazolone ring group. Both of $R^3$ and $R^4$ may be a compound substituted with a benzimidazolone ring group. In view of advantageous effect, both of $R^3$ and $R^4$ are preferably benzimidazolone ring groups.

structural formula (a)

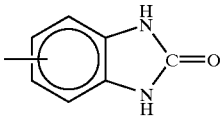

In the formula (2), Ri and Rj each independently represents a hydrogen atom, an alkyl group having 1–5 carbon atoms and preferably 1–4 carbon atoms, an alkoxy group having 1–5 carbon atoms and preferably 1–4 carbon atoms, or a halogen atom.

Examples of the alkyl group include methyl, ethyl, n-propyl, isopropyl and butyl groups. Among them, an alkyl group having 1–2 carbon atoms is preferable. Methyl and ethyl groups are especially preferable.

Examples of the alkoxy group include methoxy, ethoxy, propoxy, and butoxy groups. Among them, an alkoxy group having 1–2 carbon atoms is preferable. Methoxy and ethoxy groups are especially preferable.

Among the above-mentioned groups, a hydrogen atom, and methyl and ethyl groups are especially preferable for Ri and Rj.

In the formula (2), p and q each independently represents an integer of 1–4. If p is at least 2, Ri's may be the same as or different from each other. If q is at least 2, Rj's may be the same as or different from each other.

The two aromatic groups having Ri and Rj in the general formula (2) are connected with each other through a bilavent connecting group X, and the connecting group X may be appropriately selected, depending on use based on the hue to be obtained, or the like. Any one connecting group selected from the following groups is especially preferable since a harmful decomposition product is not produced even by thermal decomposition.

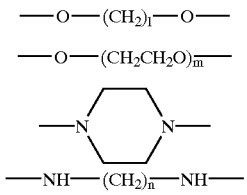

In the above-mentioned formulas, 1 and n each independently represents an integer of 2–10. Preferable is an integer of 2–4. m is an integer of 1–3 and preferably 1–2.

As described above, the compound represented by the general formula (2), in particular a pigment having a benzimidazolone ring group which is represented by the general formula (2), exhibits very high heat resistance, and does not easily decompose thermally even when high-temperature recording is performed by thermal transfer using a laser. Therefore, the compound can suppress a drop in image density and density unevenness after the transfer, resulting from thermal decomposition of the pigment. Thus, it is possible to form an image having high image density and high quality and having no image defects such as transfer unevenness.

The compound represented by the general formula (2) has a structure wherein the two aromatic rings are connected with each other through the connecting group X. This structure makes it possible to prevent the generation of a harmful decomposition product even when the compound decomposes thermally at high temperatures. The thermal transfer material comprising as a pigment this compound can ensure the safety of human bodies even when the pigment is thermally decomposed at the time of thermal transfer by a laser.

Among the compounds represented by the general formula (2), any compound having a benzimidazolone ring group represented by the structural formula (a) is especially preferable since the compound has very good heat resistance at high temperatures and does not easily decompose thermally.

As described above, the pigment having a benzimidazolone ring group, which is represented by the general formula (2), exhibits very high heat resistance, and does not easily decompose thermally even when high-temperature recording is performed by thermal transfer using a laser. Therefore, the compound can suppress a drop in image density and density unevenness after the transfer resulting from thermal decomposition of the pigment. Thus, it is possible to form an image having high image density and high quality and having no image defects such as transfer unevenness. The transfer unevenness referred to herein refers to a phenomenon in which, at the time of thermal transfer recording, the transfer density at the central portion of a scanning line of laser light becomes thin, and conversely the transfer density at both end portions of the scanning line becomes thick. The difference between these densities makes its appearance as density unevenness in the formed image.

Even if this compound decomposes thermally, no harmful materials are generated.

By selecting $R^3$, $R^4$ and the connecting group X appropriately within the above-mentioned ranges in the compound represented by the general formula (2), a pigment having a desired hue can be obtained. This compound can be used as a pigment in an image forming layer of each of thermal transfer materials for blue (B), green (G) and red (R) colors, which are used to form a full color image.

In a case in which the compound represented by the general formula (2) or (2)' is used as a color proof, the compound is preferably used as a yellow pigment in the image forming layer because of a good hue thereof.

In the laser thermal recording method in which image recording is effected by laser light, a laser having a high output energy is used to increase recording speed. This laser is further converged to a beam having a very small focus diameter of about 10 $\mu$m. The resultant laser is converted to thermal energy. Therefore, a great deal of heat capacity can be obtained at the area irradiated with the laser so that the area is heated to a very high temperature.

Accordingly, image recorded is effected by applying an amount of heat higher than that from heating devices that are conventionally used for thermal recording, such as a thermal head or thermal roller. Therefore, the area irradiated with the laser is heated to a high temperature so that a pigment present at the irradiation area easily decomposes thermally.

If the pigment decomposes thermally, its hue is lost. As a result, the color density of the image forming layer which is thermally transferred by laser radiation drops. Moreover, the drop in the density arises unevenly. Thus, the density of the image formed after the thermal transfer becomes uneven. That is, any high-quality image having a high and uniform density cannot be formed and image defects such as transfer unevenness are caused.

Furthermore, by the thermal decomposition of the pigment, the pigment emits decomposition products harmful to human bodies. The emission of the harmful decomposition products causes deterioration in working environments and a bad effect on human bodies.

In the laser thermal transfer material of the present invention, the compound represented by the general formula (2) is contained as a pigment in an image forming layer. As a result, even if the compound decomposes thermally, it is possible to prevent harmful materials from being generated and keep safety even in high-speed recording using a laser having a high power.

By using the compound represented by the general formula (2) as a pigment, heat resistance is given to the pigment itself so that thermal decomposition can be suppressed. Accordingly, the pigment does not easily decompose thermally even upon thermal transfer recording using a laser so that a drop in image density after the transfer, which is based on such thermal decomposition, can be suppressed. Thus, it is possible to form stably a high-quality image without a drop in image quality based on density unevenness or image defects such as transfer unevenness.

The content of the pigment represented by the general formula (2) is preferably 25 to 70% and more preferably 30 to 60% by weight of the total solid of the image forming layer.

If the above-mentioned content is below 25% by weight, the amount of the pigment which decomposes thermally upon laser recording is large. Thus, it is not sufficiently possible to prevent a drop in image density and image quality after transfer or prevent generation of image defects, such as transfer unevenness, and harmful materials. If the content is over 70% by weight, the binder content drops relatively so that the strength of recorded images drops. Thus, injuries are easily generated and handling performance deteriorates.

The pigment represented by the general formula (1) may be used alone or together with one or more of other coloring agents.

As the other coloring agents, known organic pigments or inorganic pigments may be used. The former is especially good in transparency of the resultant coat. The latter is generally good in shield effect.

Examples of black coloring agents include inorganic carbon black, triiron tetraoxide, and organic cyanine black.

Examples of yellow pigments include inorganic lead yellow, cadmium yellow, yellow iron oxide, titanium yellow, ochre, anilide acetoacetate monoazopigments of poorly soluble metal salts (azolake), anilide acetoacetate disazo pigments, condensed azo pigments, benzimidazolone monoazo pigments, and isoindolinone pigments.

Examples of the anilide acetoacetate monoazopigments of poorly soluble metal salts (azolake) include Hansa Yellow G (C. I. No. pigment Yellow 1), Hansa Yellow 10G (pigment Yellow 3), Hansa Yellow RN (pigment Yellow 65), Hansa Brilliant Yellow 5GX (pigment Yellow 74), Hansa Brilliant Yellow 10GX (pigment Yellow 98), Permanent Yellow FGL (pigment Yellow 97), Symuler Lake Fast Yellow 6G (pigment Yellow 133), and Lionol Yellow K-2R (pigment Yellow 169).

Examples of the anilide acetoacetate disazo pigments include Disazo Yellow G (pigment Yellow 12), Disazo Yellow GR (pigment Yellow 13), Disazo Yellow 5G (pigment Yellow 14), Disazo Yellow 8G (pigment Yellow 17), Disazo Yellow R (pigment Yellow 55), and Permanent Yellow HR (pigment Yellow 83).

Examples of the condensed azo pigment include Cromophthal Yellow 3G (pigment Yellow 93), Cromophthal Yellow 6G (pigment Yellow 94), and Cromophthal Yellow GR (pigment Yellow 95).

Examples of the benzimidazolone monoazo pigments include Hostaperm Yellow H3G (pigment Yellow 154), Hostaperm Yellow H4G (pigment Yellow 151), Hostaperm Yellow H2G (pigment Yellow 120), Hostaperm Yellow H6G (pigment Yellow 175), and Hostaperm Yellow HLR (pigment Yellow 156).

Examples of the isoindolinone pigments include Irgazin Yellow 3RLT (pigment Yellow 110), Irgazin Yellow 2RLT, Irgazin Yellow 2GLT (pigment Yellow 109), Fastogen Super Yellow GROH (pigment Yellow 137), Fastogen Super Yellow GRO (pigment Yellow 110), and Sandorin Yellow 6GL (pigment Yellow 173).

Examples of yellow pigment that can be used include threne pigments such as Flavanthrone (pigment Yellow 24), Anthrapyrimidine (pigment Yellow 108), Phthaloylamide type anthraquinone (pigment Yellow 123), Helio Fast Yellow E3R (pigment Yellow 99); metal complex pigments as azo nickel complex pigments (pigment Green 10), nitroso nickel complex pigments (pigment Yellow 153) and azomethine copper complex pigments (pigment Yellow 117); and quinophthalone pigments such as phthalimide quinophthalone pigments (pigment Yellow 138).

Examples of inorganic magenta pigments include cadmium red, red iron oxide, vermilion, red lead, and antimony vermilion.

Examples of organic magenta pigments include azo lake type azo pigments, insoluble azo pigments (monoazo, disazo and condensed azo pigments), condensed azo pigments, anthraquinone pigments, which are condensed polycyclic pigments, thioindigo pigments, perynone pigments, perylene pigments, and quinaquridon pigments.

Examples of the azo lake type azo pigments include Brilliant Carmine 6B (pigment Red 57:1), Lake Red (pigment Red 53:1), Permanent Red F5R (pigment Red 48), Lithol Red (pigment Red 49), Persia Orange (pigment Red 17), Crosey Orange (pigment Red 18), Helio Orange TD (pigment Red 19), Pigment Scarlet (pigment Red 60:1), Brilliant Scarlet G (pigment Red 64:1), Helio Red RMT (pigment Red 51), Bordeaux 10B (pigment Red 63) and Helio Bordeaux BL (pigment Red 54).

Examples of the insoluble azo pigments (monoazo, disazo and condensed azo pigments) include Para Red (pigment Red 1), Lake Red 4R (pigment Red 3), Permanent Orange (pigment Red 5), Permanent Red FR2 (pigment Red 2), Permanent Red FRLL (pigment Red 9), Permanent Red FGR (pigment Red 112), Brilliant Carmine hBS (pigment Red 114), Permanent Carmine FB (pigment Red 5), P. V. Carmine HR (pigment Red 150), Permanent Carmine FBB (pigment Red 146), Novoperm Red F3RK-F5RK (pigment Red 170), Novepalm RedHFG (pigment Orange 38), NovopermRedHF4B (pigment Red 187), Novoperm Orange HL. HL-70 (pigment Orange 36), P. V. Carmine HF4C (pigment Red 185), Hostaperrm Brown HFR (pigment Brown 25), Vulcan Orange (pigment Orange 16), and Pyrazolone Red (pigment Red 38).

Examples of the condensed azo pigments include Cromophthal Orange 4R (pigment Orange 31), Cromophthal Scarlet R (pigment Red 166), and Cromophthal Red BR (pigment Red 144).

Examples of anthraquinone pigments, which are condensed polycyclic pigments, include Pyranthrone Orange (pigment Orange 40), Anthanthrone Orange (pigment Orange 168), and Dianthraquinonyl Red (pigment Red 177).

Examples of the thioindigo pigments include Thioindigo magenta (pigment Violet 38), Thioindigo Violet (pigment Violet 36) and Thioindigo Red (pigment Red 88).

Examples of the perynone pigments include Perynone Orange (pigment Orange 43).

Examples of the perylene pigments include Perylene Red (pigment Red 190), Perylene Vermilion (pigment Red 123), Perylene Maroon (pigment Red 179), Perylene Scarlet (pigment Red 149), and Perylene Red (pigment Red 178).

Examples of the quinaquridon pigments include Quinaquridon Red (pigment Violet 19), Quinaquridon Magenta (pigment Red 122), Quinaquridon Maroon (pigment Red 206), and Quinaquridon Scarlet (pigment Red 207).

Examples of other pigments include pyrrocoline pigments, red color fluorubine pigments, and vat lake pigments (water-soluble dye+precipitant→Lake solidification and adhesion).

Examples of cyan coloring agents include inorganic pigments such as ultramarine, Prussian blue, cobalt blue, and cerulean blue; and organic pigments such as phthalocyanine pigments.

Examples of the phthalocyanine pigments include Fastogen Blue BB (pigment Blue 15), Sumiton Canyne Blue HB (pigment Blue 15), Cyanine Blue 5020 (pigment Blue 15:1), Sumika Print Cyanine Blue GN-O (pigment Blue 15), Fast Sky Blue A-612 (pigment Blue 17), Cyanine Green GB (pigment Green 7), Cyanine Green S537-2Y (pigment Green 36), and Sumiton Fast Violet RL (pigment Violet 23).

There may also be used, for example, Indanthrone Blue (PB-60P, PB-22, PB-21andPB-64), as threne pigments, and Methyl Violet Phosphorus Molybdic acid Lake (PV-3), as a basic dye lake pigment.

In a case in which one or more of the above-mentioned other pigments are used with the pigment represented by the general formula (2), the used amount of the former pigment (s) in the image forming layer is preferably 1 to 40% and more preferably 1 to 20% by weight of the pigment represented by the general formula (2).

If the used amount is over 40% by weight, the amount of the thermally decomposed pigment upon laser recording becomes large so as to cause highly a drop in image density and image defects such as transfer unevenness, and generate a large amount of harmful materials.

The following will describe any quinophthalone compounds represented by the general formula (3).

general formula (3)

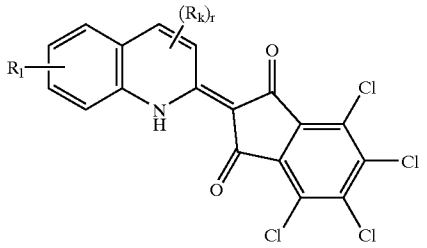

In the general formula (3), Rk represents a hydrogen atom, an alkyl group having 1–5 carbon atoms or an alkoxy group having 1–5 carbon atoms.

Examples of the alkyl group having 1–5 carbon atoms include methyl, ethyl, n-propyl, isopropyl, butyl, and pentyl groups. Among them, methyl and ethyl groups are preferable.

Examples of the alkoxy group having 1–5 carbon atoms include methoxy, ethoxy, propoxy, butoxy and pentyloxy groups. Among them, methoxy and ethoxy groups are preferable.

A hydrogen atom, a methyl group and a methoxy group are preferable for Rk.

r is an integer of 1 or 2. If r is 2, Rk's may be the same or different from each other.

In the general formula (3), Rl represents a tetrachlorophthaloimidyl group represented by the following structural formula (b):

structural formula (b)

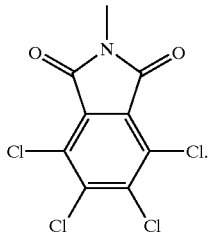

The pigment represented by the general formula (3), as well as the general formula (2), exhibits very high heat resistance. The pigment does not easily decompose thermally even if high-temperature recording is performed by thermal transfer recording using a laser. Thus, it is possible to form stably a high-quality image having a high image density and no image defects such as transfer unevenness.

The following describes a monoazo compound having a benzimidazolone ring, which is represented by the general formula (4).

general formula (4)

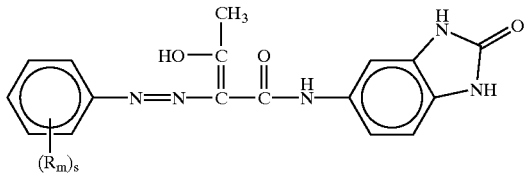

In the general formula (4), Rm represents an alkoxycarbonyl group having 2–5 carbon atoms, an alkyl group having 1–5 carbon atoms or an alkoxy group having 1–5 carbon atoms.

Examples of the alkoxycarbonyl group having 2–5 carbon atoms include —$COOCH_3$, —$COOC_2H_5$ and —$COOC_3H_7$. Among them, preferable is —$COOCH_3$.

The alkyl group having 1–5 carbon atoms, and the alkoxy group having 1–5 carbon atoms are the same as for Rk in the general formula (3).

s is an integer of 1–5. If s is at least two, Rm's may be the same as or different from each other.

The pigment represented by the general formula (4), as well as the general formulas (2) and (3), exhibits very high heat resistance. The pigment does not easily decompose thermally even when high-temperature recording is performed by thermal transfer recording using a laser. Thus, it is possible to form stably a high-quality image having a high image density and no image defects such as transfer unevenness.

The following will describe any condensed azo compound represented by the general formula (5).

general formula (5)

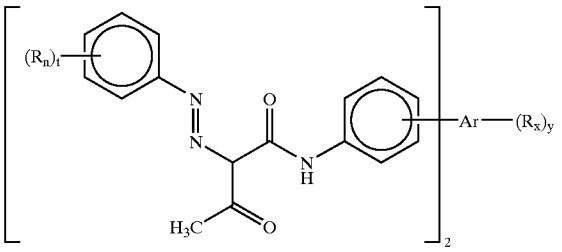

In the general formula (5), Ar represents an arylene group. The arylene group may have a substituent. Rx as the substituent represents an hydrogen atom, an alkyl group having 1–5 carbon atoms or an alkoxy group having 1–5 carbon atoms.

In the general formula (5), y is an integer of 1–4. If y is at least 2, Rx's may be the same as or different from each other.

The alkyl group having 1–5 carbon atoms, and the alkoxy group having 1–5 carbon atoms are the same as for Rk in the general formula (3).

Among the arylene group which may have a substituent, a phenylene, in which Rx is a hydrogen atom, is especially preferable.

In the general formula (5), Rn represents a hydrogen atom, an alkoxycarbonyl group having 2–5 carbon atoms, an alkyl group having 1–5 carbon atoms or an alkoxy group having 1–5 carbon atom.

The alkoxycarbonyl group having 2–5 carbon atoms are the same as for Rm in the general formula (4). The alkyl group having 1–5 carbon atoms and the alkoxy group having 1–5 carbon atom are the same as for Rk in the general formula (3).

In the general formula (5), t is an integer of 1–5. If t is at least 2, Rn's may be the same as or different from each other.

The pigment represented by the general formula (5), as well as the general formulas (2) to (4), exhibits very high heat resistance. The pigment does not easily decompose thermally even if high-temperature recording is performed by thermal transfer recording using a laser. Thus, it is possible to form stably a high-quality image having a high image density and no image defects such as transfer unevenness.

In laser thermal recording for recording an image by laser light, a laser having a high output energy is used. This laser is further converged to a beam having a very small focus diameter of about 10 $\mu$m. The resultant laser is converted to thermal energy. Therefore, a great deal of heat capacity can be obtained at the area irradiated with the laser so that recording speed can be made fast and the irradiation area is heated to a very high temperature. In this case, energy having an amount of heat higher than that of heating devices that are conventionally used for thermal recording, such as a thermal head or thermal roller, is applied.

Conventionally, at such a high temperature, pigments decompose thermally to result in a drop in image density. However, by using one or more of the above-mentioned pigments (the compounds represented by the general formulas (1) to (5)) as a coloring agent or coloring agents, it is possible to prevent the loss of hues resulting from thermal decomposition of the pigments upon thermal transfer recording and form an image having a high density without a drop in image density.

When such a pigment as above decomposes thermally, the drop in the density thereof or the loss of the hue thereof is not uniformly caused. Thus, the density of the resultant image after thermal transfer becomes uneven so that a high-quality image having an even and high density cannot be formed. The generation of decomposition products resulting from the thermal decomposition makes even transfer impossible, and results in image defects such as transfer unevenness.

When the compound represented by the general formula (1) is used as a coloring agent, one or more of other known pigments may be used together to give a desired hue or density. The proportion of the known pigment(s) may be appropriately selected depending on the hue or density of a desired image.

Two or more of the compounds represented by the general formulas (1) to (5) may be appropriately selected and used together. The two or more compounds may be used together with one or more of other known pigments.

The total content (% by weight) of the pigment(s) in the image forming layer is preferably 25 to 70% and more preferably 30 to 60% by weight of the whole of the image forming layer.

The total content (% by weight) of the pigment(s) represented by the general formulas (1) to (5) is preferably 50 to 100% and preferably 80 to 100% by weight of the whole of the pigments.

If the above-mentioned total content is below 50% by weight, the amount of the pigments which decompose thermally upon thermal transfer recording is large so as to cause a drop in image density and image defects.

Among the above-mentioned combinations, preferable is any combination of the compound (pigment) represented by the general formula (1) and at least one compound (pigment) selected from compounds represented by the general formulas (2) to (5), in order to obtain better hue in the present invention. By use of any combination of the compound represented by the general formula (1) and at least one compound selected from the compounds represented by the general formulas (2) to (5), it is possible to prevent a drop in color density resulting from thermal decomposition, and further exhibit color blend effect, thereby giving better hue.

In order to obtain good hue by use of any combination of the compound represented by the general formula (1) and the compound(s) represented by the general formulas (2) to (5), the weight ratio between the respective pigments in the image forming layer is preferably within the following range.

That is, the weight ratio of the content (X) of the compound having an isoindoline ring, which is represented by the general formula (1) to the total content (Y) of at least one compound selected from the compounds represented by the formulas (2) to (5), in the image forming layer, is preferably from 1:99 to 30:70 and preferably from 1:99 to 15:85.

When the weight ratio X/Y is out of the range above-described, it is difficult to give desired good hue.

A mean particle diameter of the pigments contained in the image forming layer is preferably in a range of 0.03 to 1 μm, and more preferably 0.05 to 0.5 μm.

When the mean particle diameter is less than 0.03 μm, the dispersion cost may increase or gelation of a dispersion solution may occur. When the mean particle diameter exceeds 1 μm, coarse particles in a pigment may impede close-contact of the image forming layer with the image receiving layer.

In the present invention, the content of pigment particles whose mean particle diameter is 1 μm or more in the pigment containing image forming layer coating solution with respect to the total solid weight of the image forming layer is preferably 3% by weight or less.

If the content of the pigment particles whose mean particle diameter is 1 μm or more exceeds 3% by weight, when the image forming layer is brought into contact with the image receiving layer of a thermal transfer image receiving material which will be described later, difficulties in contact of the layers to each other in vicinities of such coarse pigment particles are likely to arise. Thus, thermal transferability of the thermal transfer material to the image receiving layer deteriorates to cause poor image transfer (transfer unevenness) due to microscopic air gaps formed at the contact surface between the image forming layer and the image receiving layer.

Examples of an amorphous organic high polymer which may be contained in the image forming layer and which has a softening point ranging from 40 to 150° C., include: butyral resins; polyamide resins; polyethyleneimine resins; sulfonamide resins; polyesterpolyol resins; petroleum resins; homopolymers or copolymers of vinyltoluene, styrene, α-methylstyrene, 2-methylstyrene, chlorostyrene, vinylbenzoic acid, sodium vinylbenzenesulfonate, aminostyrene and derivatives or substituents thereof; homopolymers or copolymers of vinyl monomers such as methacrylates or methacrylic acid such as methyl methacrylate, ethyl methacrylate, butyl methacrylate, and hydroxyethyl methacrylate, acrylates or acrylic acid such as methyl acrylate, ethyl acrylate, butyl acrylate, and α-ethylhexyl acrylate, dienes such as butadiene and isoprene, acrylonitrile, vinyl ethers, maleic acids and maleic acid esters, homopolymers of vinyl monomers such as maleic anhydride, cinnamic acid, vinyl chloride, and vinyl acetate, or copolymers in combination with other monomers, or the like.

Two or more of these resins can be used in combination.

The content of the amorphous organic high polymer is preferably 70 to 30% and more preferably 60 to 40% by weight of the total solid of the image forming layer.

In a case in which a large number of layers having images (i.e., image forming layers having images formed thereon) are superposed repeatedly on the same thermal transfer image receiving material to form a multi-color image, it is preferable for the image forming layers to include a plasticizer therein in order to increase adhesion of images to each other.

Examples of the plasticizer include: phthalates such as dibutyl phthalate, di-n-octyl phthalate, di(2-ethylhexyl) phthalate, dinonyl phthalate, dilauryl phthalate, butyllauryl phthalate, and butylbenzyl phthalate; esters of aliphatic dibasic acids such as di(2-ethylhexyl) adipate and di(2-ethylhexyl) sebacate; triesters of phosphoric acid, such as tricresyl phosphate and tri (2-ethylhexyl) phosphate; polyol polyesters such as polyethylene glycol esters; and epoxy compounds such as esters of epoxidized fatty acids.

In addition to the aforementioned ordinary plasticizers, suitable examples of plasticizers include: acrylates, such as polyethylene glycol dimethacrylate, 1,2,4-butanetriol trimethacrylate, trimethylolethane triacetate, pentaerythritol triacrylate, pentaerythritol tetraacrylate, and dipentaerythritol polyacrylate, and used in the present invention depending on the type of the binder used. Two or more of these plasticizers may be used in combination.

Generally, the plasticizer is added to the image forming layer such that a content ratio (weight ratio) of the total amount of the pigment and the amorphous organic polymer to the plasticizer is generally in a range of 100:0.5 to 1:1, and preferably 100:2 to 3:1.

In addition to the aforementioned components, a surfactant, a thickener, and the like may be added to the image forming layer as needed.

The thickness (dry layer thickness) of the image forming layer preferably ranges from 0.2 to 1.5 μm, and more preferably ranges from 0.3 to 1.0 μm.

Each of the aforementioned components is dissolved in a solvent to prepare a solution (an image forming layer coating solution), and this is applied onto a support by a known coating method and dried to thereby form an image forming layer.

The solvents to be used for the preparation of the image forming layer coating solution can be appropriately selected, in accordance with existence or non-existence of a light-to-heat conversion layer or the like, from the following solvents: alcohols such as ethyl alcohol, propyl alcohol or the like, ketones such as aceton, methyl ethyl ketone or the like, esters such as ethyl acetate, aromatic hydrocarbons such as toluene, xylene or the like, ethers such as tetrahydrofuran, dioxane or the like, amides such as DMF, N-methylpyrrolidone or the like, cellosolves such as methylcellosolve or the like. These solvents can be used solely, or two or more of them can be used in combination.

In order to prevent damage to the surface of the image forming layer, usually, a thermal transfer image receiving material, or a protective cover film such as a polyethylene terephthalate sheet or a polyethylene sheet can be laminated on the surface of the image forming layer.

When image recording is effected, a laminate is used wherein the thermal transfer material and the thermal transfer image receiving material are laminated so that the image receiving layer of the thermal transfer image receiving material comes into contact with the image forming layer of the thermal transfer material. This laminate is then exposed imagewise to laser light. In this way, the image forming layer of the thermal transfer material is transferred onto the image receiving layer of the thermal transfer image receiving material. Therefore, if close contact of the thermal transfer image receiving material with the thermal transfer material of the former laminate is neither sufficient nor uniform throughout the interface thereof, thermal conductivity of thermal energy converted from a radiation laser to the image receiving layer is blocked. Particularly, in a case in which a laser having a high power is used, the temperature of the image forming layer of the thermal transfer material rises excessively so that the pigment in the layer easily decomposes thermally.

However, by using as a coloring agent a compound (pigment) represented by the general formula (1) and/or apigment selected from the compounds A to D, which will be described hereinafter, thermal decomposition of the pigments can be suppressed. Moreover, it is possible to prevent a drop in image density and generation of image defects, such as transfer uneveness, after thermal transfer, and to stably form an image having good hue.

In addition, by using a compound (pigment) represented by the general formula (2) as a coloring agent, generation of harmful materials can be prevented. By using, in particular, a pigment having a benzimidazolone ring group, which is represented by the general formula (2), it is possible to suppress thermal decomposition of the pigment and prevent a drop in image density after transfer, a drop in image quality due to density unevenness and image defects such as transfer unevenness. Thus, an image having high quality can stably be formed. Moreover, generation of harmful materials can be prevented.

Light-to-heat Conversion Layer

The light-to-heat conversion layer contains therein a light-to-heat conversion substance and a binder resin (occasionally referred to hereinafter as a "light-to-heat conversion layer binder polymer"), and can contain other components if necessary.

The light-to-heat conversion substance generally refers to a laser light absorptive material such as a dye capable of absorbing a laser light. Examples of such a dye (i.e., pigment or the like) include: a black pigment such as a carbon black, a pigment, which is a macrocyclic compound capable of absorbing rays in regions ranging from the visible region to the near infrared region, such as phthalocyanine, naphthalocyanine or the like, an organic dye such as a cyanine dye (exemplified by an indolenine dye), an anthraquinone-based dye, an azulene-based dye, a phthalocyanine-based dye, or the like which is used as a laser absorptive material for a high density laser recording in an optical disk or the like, and a dye composed of an organometallic compound such as a dithiol/nickel complex or the like.

In order to increase image recording sensitivity, the light-to-heat conversion layer is preferably as thin as possible. For this reason, it is preferable to use an infrared absorptive dye such as a cyanine-based dye or a phthalocyanine-based dye which has a large light-absorptive coefficient in a laser light wavelength region.

An inorganic material such as a metallic material can also be used as a laser light-absorptive material in the light-to-heat conversion layer. The metallic material is used in the form of particles (e.g., blackened silver).

The optical density of the light-to-heat conversion substance in a region of the laser absorptive wavelength region is preferably in a range of 0.1 to 2.0, and more preferably 0.3 to 1.2.

When the optical density is less than 0.1, sensitivity of the thermal transfer material may deteriorate. When the optical density exceeds 2.0, the light-to-heat conversion layer having such an optical density is disadvantageous in view of the manufacturing cost.

Examples of the light-to-heat conversion layer binder polymer include: resins which have high glass transition points and high thermal conductivity, namely, typical heat resistant resins such as polymethylmethacrylate, polycarbonate, polystyrene, ethylcellulose, nitrocellulose, polyvinyl alcohol, gelatin, polyvinylpyrrolidone, polyparabanic acid, polyvinylchloride, polyamide, polyimide, polyetherimide, polysulfone, polyethersulfone, and aramide.

More specifically, when image recording is performed by arranging a plurality of rows of high power lasers such as multi-mode lasers, preferably, a polymer which has a high thermal resistance is used, more preferably, a polymer whose glass transition point Tg is in a range of 150 to 400° C. and whose temperature Td at which the weight of this polymer loses 5% by weight is 250° C. or more (measured by TGA method, where air temperature is increased by 10° C./min), and most preferably, a polymer whose Tg is in a range of 220 to 400° C., and whose Td is 400° C. or more.

The light-to-heat conversion layer can be formed by preparing a coating solution (i.e., a light-to-heat conversion layer coating solution) in which the light-to-heat conversion substance and the light-to-heat conversion layer binder polymer are dissolved. This coating solution is then applied to a support and then dried.

Examples of organic solvents for dissolving the light-to-heat conversion layer binder polymer include: 1,4-dioxane, 1,3-dioxolane, dimethyl acetate, N-methyl-2-pyrrolidone, dimethylsulfoxide, dimethylformamide, γ-butyrolactone or the like.

The application method used for application of the light-to-heat conversion layer coating solution can be selected from known application methods.

Drying is ordinarily conducted at 300° C. or less, and preferably at 200° C. or less. In using polyethylene terephthalate as a support, more preferably, the drying temperature is in a range of 80 to 150° C.

In the light-to-heat conversion layer which is formed as described above, the solid weight ratio of the light-to-heat conversion substance to the light-to-heat conversion layer binder polymer dye (the light-to-heat conversion substance: binder) is preferably in a range of 1:20 to 2:1, and more preferably 1:10 to 2:1.

If the amount of the binder is too small, cohesive strength of the light-to-heat conversion layer decreases, and when an image is transferred to the thermal transfer image receiving material, the light-to-heat conversion layer is liable to be transferred thereto as well, thus causing unpreferable color mixing of the image. On the other hand, if the amount of the binder is too large, the light-to-heat conversion layer need to be made thicker in order to achieve a necessary fixed light absorption ratio. This causes a deterioration of sensitivity.

The thickness of the light-to-heat conversion layer is preferably in a range of 0.03 to 0.8 μm, and more preferably 0.05 to 0.3 μm.

Preferably, the light-to-heat conversion layer has a maximum light absorbance (optical density) which is in a range of 0.1 to 1.3 (more preferably 0.2 to 1.1) in a wavelength range of 700 to 2000 nm.

The heat resistance (e.g., thermal deformation temperature or thermal decomposition temperature) of the binder polymer of the light-to-heat conversion layer is preferably higher than that of the material used for the layer to be provided on the light-to-heat conversion layer.

Heat-sensitive Peeling Layer

It is possible to provide a heat-sensitive peeling layer on the light-to-heat conversion layer of the thermal transfer material. The heat-sensitive peeling layer contains a heat-sensitive material which generates gas or releases adhesion water as a result of the action of heat generated from the light-to-heat conversion layer. The gas or adhesion water weakens the force with which the light-to-heat conversion layer and the image forming layer are held in contact with each other.

Examples of the heat-sensitive material include a compound (a polymer or a low molecular weight compound) which itself decomposes or degenerates due to the action of heat and thereby generates a gas, and a compound (a polymer or a compound having a low molecular weight)

which absorbs or takes up a large amount of easily volatile liquid such as water. Further, these compounds can be used in combination.

Examples of polymers which decompose or degenerate due to heat and thereby generate gas include: an auto-oxidizable polymer such as nitrocellulose, a halogen containing polymer such as chlorinated polyolefin, chlorinated rubber, polychlorinated rubber, polyvinyl chloride, or polyvinylidene chloride, an acrylic polymer such as polyisobutyl methacrylate in which a volatile compound such as water is adsorbed, a cellulose ester such as ethyl cellulose in which a volatile compound such as water is adsorbed, and a natural polymer compound such as gelatin in which a volatile compound such as water is adsorbed can be listed. Examples of a low molecular weight compound which decomposes or degenerates due to heat and thereby generates a gas include: a compound such as a diazo compound or an azide compound which decomposes due to heat and thereby generates a gas. Further, such decomposition or degeneration of the heat-sensitive material due to heat as described above preferably occurs at 280° C. or less, and more preferably at 230° C. or less.

In a case in which a low molecular weight compound is used as the heat-sensitive material, it is desirable that the low molecular weight compound is used in combination with a binder. Such a binder may be, for example, a polymer which itself decomposes or degenerates due to heat and thereby generates a gas, and an ordinary polymer binder not having such characteristics as described above.

In a case in which a heat-sensitive low molecular weight compound and the binder are used in combination, the weight ratio of the former to the latter is preferably in a range of 0.02:1 to 3:1, and more preferably 0.05:1 to 2:1.

It is preferable that the heat-sensitive peeling layer covers the entire surface of the light-to-heat conversion layer. The thickness of the heat-sensitive peeling layer is generally in a range of 0.03 to 1 $\mu$m, and preferably 0.05 to 0.5 $\mu$m.

In a case where the thermal transfer material is structured such that the light-to-heat conversion layer, the heat-sensitive peeling layer, and the image forming layer are laminated in that order and are provided on a support, the heat-sensitive peeling layer is decomposed or degenerated to thereby generates a gas due to heat transmitted from the light-to-heat conversion layer. Then, due to this decomposition or generation of a gas, a portion of the heat-sensitive peeling layer disappears or the heat-sensitive peeling layer become unable to stay in close contact with each other, and close-contact strength with which the light-to-heat conversion layer and the image forming layer are held in contact with each other deteriorates. Because of this behavior of the heat-sensitive peeling layer, a portion of the heat-sensitive peeling layer may come in tight contact with the image forming layer, and that portion may appear on the surface of the resulting image, thus causing color mixture of the image.

It is desirable that the heat-sensitive peeling layer is non-colored (i.e., it is desirable that the heat-sensitive peeling layer exhibits high transmission with respect to visible light) to prevent the appearance of color mixture on the image which has been formed even when such image transfer as described above of the heat-sensitive peeling layer is performed. More specifically, a light absorption coefficient of the heat-sensitive peeling layer is preferably 50% or less with respect to visible light, and more preferably 10% or less.

Instead of a heat-sensitive peeling layer being provided separately, the light-to-heat conversion layer can be used as a heat-sensitive peeling layer by adding a heat-sensitive material to the light-to-heat conversion layer.

Cushion Layer

In order to improve close-contact ability of the thermal transfer image receiving material to the surface of the image receiving layer, it is preferred to dispose a cushion layer, as an intermediate layer having cushion ability, between the support and the light-to-heat conversion layer of the thermal transfer material.

The cushion layer has a layer which easily deforms when stress is applied to the image forming layer, and has the effects of improving close-contact ability between the image forming layer and the image receiving layer during the laser thermal transfer process, and of improving image quality as well. Further, during image recording, even if foreign matter enters between the thermal transfer material image receiving layer and the thermal transfer material, air gaps formed between the image receiving layer due to the deformation of the cushion layer, and the size of defects of dropping-out of images is reduced. As a result, the cushion layer can minimize size of defective image portions such as undyed and left white portions. Further, when the image which has been formed on the image receiving layer is then printed (transferred) on printing paper or the like which is prepared separately, the image receiving surface can be deformed according to surface roughness of the printing paper. Therefore, due to the effect of the cushion layer, the transfer performance of the image receiving layer can be improves. Further, due to the effect of the cushion layer, the gloss of image receiving materials can be decreased or controlled, and therefore reproducibility of the original image can be improved.

In order to apply cushioning characteristics to the cushion layer, a material having a low elastic modulus, a material having a rubber elastic modulus, or a thermal plastic resin which easily softens when heated can be used.

The elastic modulus is preferably in a range of 10 to 500 kgf/cm$^2$, and more preferably 30 to 150 kgf/cm$^2$ at the room temperature.

In order to immerse foreign matter such as rubber or the like, penetration (25° C., 100 g, 5 seconds) which is specified by JIS K2530 of the cushion layer is preferably 10 or more.

The glass transition temperature of the cushion layer is 80° C. or less, and preferably 25° C. or less. In order to control physical properties such as Tg, addition of a plasticizer to the polymer binder can be suitably performed.

Examples of binders for forming the cushion layer include: rubbers such as urethane rubber, butadiene rubber, nitrile rubber, acrylic rubber, natural rubber and the like, as well as polyethylene, polypropylene, polyester, a styrene-butadiene copolymer, an ethylene-vinyl acetate copolymer, an ethylene-acrylic copolymer, a vinyl chloride-vinyl acetate copolymer, a vinylidene chloride resin, a plasticizer containing vinyl chloride resin, a polyamide resin, a phenol resin, and the like.

Generally, the thickness of the cushion layer depends on the type of resin or other conditions, but usually, the thickness of the cushion layer preferably ranges from 3 to 100 $\mu$m, and more preferably ranges from 10 to 50 $\mu$m.

Support

The support that can be used in the thermal transfer material is not especially limited. An appropriate material can be selected from various materials, depending on the purpose.

Examples of the support material include synthetic resins such as polyethylene terephthalate, polyethylene/2,6-naphthalate, polycarbonate, polyethylene, polyvinyl chloride, polyvinylidene chloride, polystyrene, and styrene/ acrylonitril copolymers. Among them, biaxially oriented polyethylene terephthalate is preferable from the standpoint of mechanical strength and stability in dimension against heat. In a case in which the thermal transfer material is used to form a color proof using laser recording, the support is preferably a transparent synthetic resin material through which a laser transmits.

In order to improve close-contact ability between the support and the light-to-heat conversion layer thereon, the support may be subjected to a surface-activating treatment. Alternatively, one or more undercoats maybe deposited thereon.

The surface-activating treatment may be, for example, a corona discharging treatment or a glow discharging treatment.

The material of the undercoat is preferably a material having close contact with both surfaces of the support and the light-to-heat conversion layer, low thermal conductivity and excellent heat resistance. Examples of such a material of the undercoat include styrene, styrene/butadiene copolymers, and gelatin. The thickness of the whole of the undercoat is usually 0.01 to 2 $\mu$m.

If necessary, one or more of various functional layers such as a reflection preventive layer may be deposited on the support surface having no light-to-heat conversion layer, or the support surface may be subjected to a surface treatment.

As described above, according to use of the laser thermal transfer material of the present invention, it is possible to suppress thermal decomposition of the pigment(s) therein upon laser thermal transfer recording, prevent a drop in image density and a drop in image quality based on density unevenness, after the transfer, and stably form a high quality image having good hue.

Moreover, by using the laser thermal transfer material of the present invention, it is possible to prevent generation of harmful materials upon image-recording. Thermal decomposition of the pigment(s) based on laser heat is also suppressed to prevent a drop in image density and generation of image defects such as transfer unevenness, after transfer. Thus, an image having high quality can stably be formed. At the same time, generation of harmful materials can also be prevented.

Thermal transfer image receiving material

The thermal transfer image receiving material can be structured in any form provided that it retains an image from the laser thermal transfer material of the present invention by a thermal transfer process. For example, the thermal transfer image receiving material can be structured such that at least an image receiving layer is provided on a support. This support is provided separately from that of the aforementioned thermal transfer material. The thermal transfer image receiving material may also be structured to have other layers such as an undercoat layer, a cushion layer, a peeling layer, and an intermediate layer between the support or the image receiving layer if necessary.

Further, providing a backing layer at a side opposite to the side at which the image forming layer is provided is also preferable in view of conveyance, storability, and surface roughening capability of the surface of the image receiving material when the thermal transfer image receiving material is taken-up in a roll. Further, providing an antistatic layer separately from these layers or adding an antistatic agent to each of the above-described layers is also preferable.

Image Receiving Layer

The image receiving layer is a layer which is formed with an organic polymer binder as a main component.

The organic polymer binder (occasionally referred to hereinafter as an "image receiving layer binder polymer") is preferably a thermoplastic resin. Examples of the resin include: homopolymers or copolymers of acrylic monomers such as acrylic acid, methacrylic acid, acrylates, and methacrylates; cellulose-based polymers such as methyl cellulose, ethyl cellulose, and cellulose acetate; vinyl-based homopolymers and copolymers of vinyl-based monomers such as polystyrene, polyvinyl pyrrolidone, polyvinyl butyral, polyvinyl alcohol, and polyvinyl chloride; condensation polymers such as polyesters and polyamides; and rubber-based polymers such as butadiene/styrene copolymers.

In order to obtain appropriate close-contact-power between the image receiving layer and the image forming layer, a glass transition temperature (Tg) of the image receiving layer binder polymer is preferably less than 90° C. It is possible to add a plascticizer to the image receiving layer. Further, Tg of the image receiving layer binder polymer is preferably 30° C. or more in order to prevent blocking between sheets.

In order to improve close-contact ability between the image forming layer and the image receiving layer during image recording by irradiation of a laser and to improve sensitivity or image stability, a polymer, which is the same as or similar to the binder polymer for the image forming layer, is preferably used in the image receiving layer.

The thickness of the image receiving layer preferably ranges from 0.3 to 7 $\mu$m, and more preferably from 0.7 to 4 $\mu$m.

If the thickness of the image receiving layer is less than 0.3 $\mu$m, when an image may be transferred (printed) onto printing paper, film strength may be insufficient and may become liable to be broken. If the thickness is more than 7 $\mu$m, after the image has been printed on printing paper, the gloss of the image may increase, and reproducibility of the original image may thereby deteriorate.

The plasticizer for the image receiving layer can be the same plasticizers which can be used for the image forming layer.

Support

A support used for the thermal transfer image receiving material may be, for example, exemplified by a base material in the form of a sheet such as a plastic sheet, a metal sheet, a glass sheet, paper or the like.

Examples of the plastic sheet include: a polyethylene terephthalate sheet, a polyethylene naphthalate sheet, a polycarbonate sheet, a polyethylene sheet, a polyvinyl chloride sheet, a polyvinylidene chloride sheet and a polystyrene sheet. A polyethylene naphthalate sheet is particularly preferable.

Examples of the paper include printing paper and coated paper.

Further, in view of cushioning characteristics, image visibility or the like, a white material having bubbles inside is preferably used as a support. In particular, in view of mechanical properties, use of an expanded polyester support is most preferable.

In order to improve close-contact ability between the image receiving layer and the support, the surface of the support can be treated with a corona discharging treatment or a glow discharging treatment.

The thickness of the support is generally in a range of 10 to 400 $\mu$m, and particularly preferably 25 to 200 $\mu$m.

Backing Layer

In order to improve surface roughening of the surface of the image receiving layer or conveying performance inside an image recording device, additives such as tin oxide fine particles, antistatic agents formed by fine particles such as silicon dioxide, or surfactants may be added to the backing layer.

These additives can be added not only to the backing layer but also to the image receiving layer and/or other layers if necessary.

Examples of the fine particles include: inorganic fine particles such as silicon dioxide, calcium carbonate, titanium dioxide, aluminum oxide, zinc oxide, barium sulfate, and zinc sulfate; and organic fine particles made of resins such as a polyethylene resin, a silicone resin, a fluorine containing resin, an acrylic resin, a methacrylic resin, and a melamine resin. Titanium dioxide, calcium carbonate, silicon dioxide, a silicone resin, an acrylic resin, and a methacrylic resin are particularly preferable. The mean particle diameter of the fine particles is preferably in a range of 0.5 to 10 $\mu$m and more preferably 0.8 to 5 $\mu$m.

The content of fine particles with respect to the total solid weight of the backing layer or the image receiving layer, is preferably in a range of 0.5 to 80% by weight, and more preferably 1 to 20% by weight.

The antistatic agent can be appropriately selected and used from various surfactants and electrically conductive agents such that the surface resistance of the backing layer is preferably $10^{12}$ Ω or less, and more preferably $10^{9}$ Ω or less under environmental conditions of 23° C. and 50%RH.

As described above, two aspects have been presented as examples of the thermal transfer image receiving material: an aspect (1) in which the material has the image receiving layer on the support, and an aspect (2) in which the material has the image receiving layer on one surface of the support and the backing layer containing fine particles on the other surface thereof. However, the present invention is not limited to these two aspects. The present invention can be the aspects described below. Namely, the present invention can be exemplified by an aspect (3) in which the thermal transfer image receiving material has a cushion layer provided between the support of (2) and the image receiving layer, or by an aspect (4) in which this material further contains in the image receiving layer of aspect (3), fine particles similar to those which have been used for the backing layer.

In a case of the above-described aspects (2) to (4), by taking up the thermal transfer image receiving material in a roll, the surface of the image receiving layer can be roughened due to pressure exerted by the backing layer containing fine particles.

In the same manner as in the aspects (3) and (4), by providing the cushion layer as the intermediate layer under the image receiving layer, failure in close-contact of the image forming layer with the image receiving layer due to roughening of the surface of the image receiving layer can be prevented, and this cushion layer can be suitably applied to the present invention.

Cushion Layer

In order to improve close-contact ability of the image forming layer of the thermal transfer material with the surface of the image receiving layer, it is preferred to dispose a cushion layer, as a cushioning intermediate layer, between the support and the image receiving layer of the thermal transfer image receiving material.

The constituent component and the structure that can be used for this cushion layer may be the same as for the above-mentioned cushion layer formed in the thermal transfer material.

It is preferable for the image receiving layer and the cushion layer to come into close contact with each other until the laser recording stage. However, in order to transfer an image on the printing paper, the image receiving layer and the cushion layer are preferably provided so as to be peelable from each other. In order to facilitate this peeling-off, it is also preferable to provide a peeling layer having a thickness of about 0.1 to 2 $\mu$m between the cushion layer and the image receiving layer.

Preferably, this peeling layer functions as a barrier for the coating solvent when the image receiving layer is applied.

An example of a structure of the thermal transfer image receiving material is the lamination of the support/cushion layer/image receiving layer. However, in some cases, since the image receiving layer is used as the cushion layer, the thermal transfer image receiving material can be structured by the lamination of the support/cushioning characteristics containing image receiving layer, or the support/undercoat layer/cushioning characteristics containing image receiving layer. Even in this case, in order to make printing (transferring) of images onto printing paper possible, it is preferable to provide the cushioning characteristics containing image receiving layer so as to be peelable from this material. In this case, the printed image on the printing paper has excellent gloss.

The thickness of the cushion layer which is used as the image receiving layer preferably ranges from 5 to 100 $\mu$m, and more preferably ranges from 10 to 40 $\mu$m.

When the image which has been formed on the image receiving layer is then printed on the printing paper, preferably, at least one of the image receiving layer is formed by a light-curing material.

Examples of compositions of such light-curing material include: a combination of a) a photopolymerization monomer formed by at least one of a multifunctional vinyl compound and a multifunctional vinylidene compound capable of forming a photopolymer by addition polymerization, b) an organic polymer, and c) a photopolymerization initiator, and an additive such as a thermal photopolymerization inhibitor if necessary.

Examples of the monomer include: unsaturated esters of polyol, and esters of acrylic acid or methacrylic acid in particular (e.g. ethyleneglycol diacrylate, pentaerythritol tetraacrylate).

The organic polymer may be, for example, the same compositions as those used for the image receiving layer binder polymer.

Examples of the photopolymerization initiator include: ordinary radical photopolymerization initiators such as benzophenone and Michler's ketone. The photopolymerization initiator can be used in an amount of 0.1 to 20% by weight based on the total solid weight of the cushion layer.

In a case in which such a cushion layer as described above is provided, in order to prevent segmentation of fine particles caused to be contained in the roughening back layer or the image receiving layer, it is allowable to provide an intermediate layer which cannot be easily deformed by stress. It is preferable that this layer is made of a material capable of being applied to the cushion layer. This layer can be formed to include a polymers whose glass transition temperature is relatively high, such as PMMA, polystyrene, or cellulose triacetate. Thermal transfer recording method:

Next, a laser thermal transfer recording method of the present invention will be explained.

In the laser thermal transfer recording method of the present invention, a laminate is prepared by laminating the thermal transfer material and the thermal transfer image receiving material with each other so as to set the image receiving layer of the thermal transfer image receiving material and the surface of the image forming layer of the thermal transfer material in tight contact with each other. The surface of the thermal transfer material of the laminate is irradiated imagewise with a laser light in time series from the upper portion of the thermal transfer material of the laminate (i.e., from the support side of thermal transfer material). Thereafter, the thermal transfer image receiving material and the thermal transfer material are peeled off from each other to thereby obtain the thermal transfer image receiving material onto which the laser irradiation area of the image forming layer is transferred.

In a case in which the laminate is formed, various methods may be used. For example, there may be used a vacuum contact method since temperature control for a heater roller or the like is unnecessary and lamination with evenness and close contact can be rapidly attained.

In this case, in order to improve close-contact ability as described above, the surface roughness of the contact surfaces may be small. However, a reduction in pressure for creating a vacuum cannot be performed at a high speed. Conversely, if the surface roughness is made large to create a vacuum at a high speed, the degree of the reduction in the pressure is improved between the contact surfaces of the image receiving layer of the thermal transfer image receiving material and the image forming layer of the thermal transfer material. However, microfine voids are made in the contact surfaces so that thermal conductivity is impeded. Thus, transferability may drop.

In order to obtain close-contact ability suitable for image-recording, it is preferable that, with a rise in the degree of the reduction in the pressure between the contact surfaces, the surface shapes of the contact surfaces change so that the image receiving layer and the image forming layer come into contact completely and uniformly to each other. Therefore, for the purpose of improving transferability and forming a high-quality image, it is useful to provide the cushion layer to the thermal transfer material and/or the thermal transfer image receiving material.

In addition to the above-mentioned vacuum contact method, another preferable method for forming the laminate is, for example, a method of putting the thermal transfer material and the thermal transfer image receiving material upon each other in the manner that the transfer side (the image forming layer side) of the former contacts the image receiving side (the image receiving layer side) of the latter, pressing the laminate and then passing the pressed laminate through a heating roller. In this case, heating temperature is preferably 160° C. or lower, or 130° C. There is also preferably used a method of mechanically-contacting the thermal transfer image receiving material, with it being stretched, on a metal drum, and then mechanically-contacting the thermal transfer material, with it being stretched, thereon so as to cause the two to contact. Among these methods, the vacuum contact method is especially preferable.

The thermal transfer material and the thermal transfer image receiving material may be caused to contact with each other immediately before laser radiation.

In the case of the vacuum contact method, the thermal transfer image receiving material side of the laminate is usually caused to contact with the surface of a recording drum (a rotating drum having, inside it, a vacuum-creating mechanism, and having, in its surface, many microscopic openings) by vacuum drawing. Subsequently, the thermal transfer material having a size larger than the thermal transfer image receiving material is laminated, on the thermal transfer image receiving material, so as to cover the whole of the receiving material. The pressure between the contact surfaces is then reduced by vacuum drawing to attain close-contact with the two materials. In this state, the laser radiation operation is carried out such that the laminate is irradiated with the laser light from the outside thereof, that is, from the upper position of the laminate at the thermal transfer material side. The irradiation of the laser light is performed in the manner that the laser light is scanned to move back and forth in a widthwise direction of the drum. During the radiation operation, the recording drum is rotated at a fixed angular speed.

The laser thermal transfer recording method can be applied not only for formation of a black mask or a monochromatic image but can also be favorably used for formation of a multicolor image. The method for forming a multicolor image may be, for example, embodiments as follows.

In a first embodiment of the method for forming a multicolor image, the image receiving material is fixed onto a rotating drum of a recording device by a vacuum pressure-reducing method, and then the thermal transfer material is laminated on the image receiving material in the manner that the image receiving layer thereof contacts the image forming layer (hue 1) of the thermal transfer material by the vacuum pressure-reducing method. Next, laser light modulated on the basis of digital signals from color separation images of an original image is radiated to the thermal transfer material from its support side while the drum is rotated. Thereafter, the thermal transfer material is peeled from the thermal transfer image receiving material which is in a fixed state. In the same way as above, the following steps are repeated for hue 2 and hue 3, and optionally hue 4: the steps of laminating the thermal transfer material on the thermal transfer image receiving material on which the image of the hue 1 is recorded; performing laser recording; and peeling the thermal transfer material. Thus, it is possible to obtain the thermal transfer image receiving material on which a multicolor image is formed. In order to obtain a color proof image on printing paper, the thermal transfer image receiving material on which the multicolor image is formed according to the above-mentioned steps is laminated on the printing paper in the manner that its image surface contacts the printing paper. The laminate is then heated and pressed through a laminator or the like. This thermal transfer image receiving material is peeled to transfer the image together with the image receiving layer onto the printing paper.

A second embodiment of the method for forming a multicolor image includes the steps of separately preparing three types (three color) or four types (four colors) of laminates in which each heat transfer material has image forming layer including color agents of respectively different hues; irradiating each of the laminates with laser light, corresponding to the laminate, on the basis of a digital signal for each of the color images obtained by a color separation filter; peeling the thermal transfer material and the thermal transfer image receiving material off from each other. After a color separation image in each color is formed on each of the thermal transfer image receiving materials, the color separation image is transferred onto an actual support, such as printing paper or the like, prepared separately to obtain a multicolor image.

Examples of laser light sources for the image recording process include: direct laser lights, such as a gas laser such as an argon ion laser, a helium/neon laser, and a helium/cadmium laser, a solid-state laser such as a YAG laser, a semiconductor laser light, a dye laser, and excimer laser, or a laser light which is passed through a secondary harmonic element and is thereby converted to a halved wavelength. Among these examples, from a viewpoint of high power and high speed image forming capability, use of a multi-mode semiconductor laser is preferable, and use of a refractive index guided multi-mode laser diode and a lateral multi-mode laser diode are particularly preferable.

In the laser thermal transfer recording method using these thermal transfer material of the present invention, it is preferable to irradiate a laser light such that the beam diameter on the light-to-heat conversion layer is in a range of 3 to 50 μm, and preferably 7 to 30 μm.

As the result of the laser thermal transfer recording method of the present invention, an image recording using a high power laser such as a multi-mode semiconductor laser becomes possible so that images with high accuracy and high quality can be formed at high speed.

EXAMPLES

By way of working examples, the present invention will be explained hereinafter. However, the present invention is not limited to these examples. Further, "part" and "%" in the examples represent "part by weight" and "% by weight", respectively.

Examples I-1 to I-9

Preparation of Laser Thermal Transfer Materials

The following composition was put into a paint shaker (made by Toyo Seiki Seisaku-Sho Ltd.), and dispersed for 3 hours to prepare a pigment dispersion solution (1) having a mean particle size of 300 nm.

| Preparation of a pigment dispersion solution (1) | |
|---|---|
| The following compound E | 12.9 parts |
| Polyvinyl butyral (S-REC BL-SH manufactured by Sekisui Chemical Co., Ltd.) | 7.1 parts |
| Pigment dispersing agent (SOLSPERSE, made by ICI Japan) | 0.6 part |
| n-Propyl alcohol | 79.4 parts |

Glass beads having a diameter of 3 mm (media for dispersion)

Preparation of a Pigment Dispersion Solution (2)

A pigment dispersion solution (2) was prepared in a same manner as the pigment dispersion solution (1), except that the following compound A was used instead of the compound E used in the preparation of the pigment dispersion solution (1).

Preparation of a Pigment Dispersion Solution (3)

A pigment dispersion solution (3) was prepared in a same manner as the pigment dispersion solution (1), except that the following compound B was used instead of the compound E used in the preparation of the pigment dispersion solution (1).

Preparation of a Pigment Dispersion Solution (4)

A pigment dispersion solution (4) was prepared in a same manner as the pigment dispersion solution (1), except that the following compound C was used instead of the compound E used in the preparation of the pigment dispersion solution (1).

Preparation of a Pigment Dispersion Solution (1)

A pigment dispersion solution (5) was prepared in a same manner as the pigment dispersion solution (1), except that the following compound D was used instead of the compound E used in the preparation of the pigment dispersion solution (1). compound E

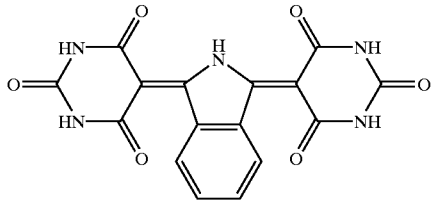

compound A

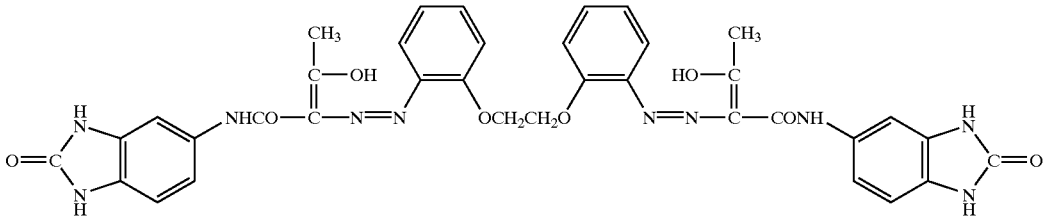

compound B

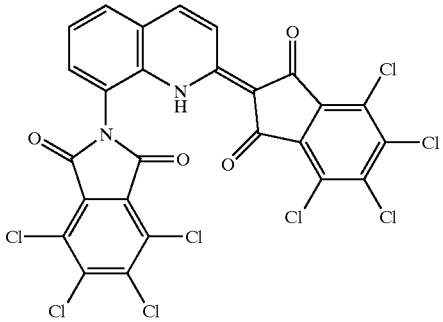

-continued compound C

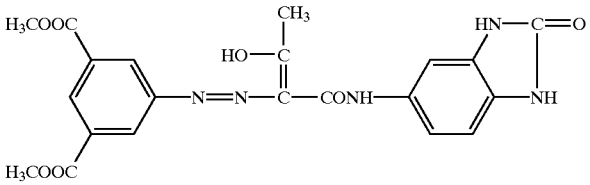

compound D

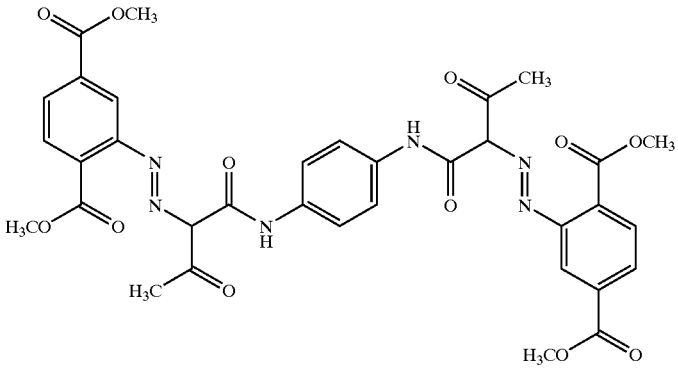

Preparation of Coating Solutions for Image Forming Layers

The following compositions were respectively blended with a stirrer to prepare coating solutions (1) to (9) for image forming layers.

(Compositions of the Coating Solutions for Image Forming Layers)

Pigment dispersion solution A described in the following Table 1 10.6 parts

Pigment dispersion solution B described in Table 1 0.6 part

Polyvinyl Butyral 0.3 part
(S-REC BL-SH manufactured by Sekisui Chemical Co., Ltd.)

Superlight Color Rosin Ester 0.2 part
(KE311, made by Arakawa Chemical Industries. Ltd.)

Behenic acid 0.2 part
(NASA-222S, made by NOF Corporation)

Fluorine-based surfactant 0.1 part
(MEGAFAC F-176PF manufactured by Dainippon Ink and chemicals Inc.)

Methyl ethyl ketone 17.6 parts n-Propyl alcohol 70.4 parts

TABLE 1

| | Sort of the coating solution | Pigment dispersion solution A | Pigment dispersion solution B |
|---|---|---|---|
| Ex. I-1 | Coating solution (1) for forming an image forming layer | Pigment dispersion solution (1) | Pigment dispersion solution (1) |
| Ex. I-2 | Coating solution (2) for forming an image forming layer | Pigment dispersion solution (2) | Pigment dispersion solution (2) |
| Ex. I-3 | Coating solution (3) for forming an image forming layer | Pigment dispersion solution (3) | Pigment dispersion solution (3) |
| Ex. I-4 | Coating solution (4) for forming an image forming layer | Pigment dispersion solution (4) | Pigment dispersion solution (4) |

TABLE 1-continued

| | Sort of the coating solution | Pigment dispersion solution A | Pigment dispersion solution B |
|---|---|---|---|
| Ex. I-5 | Coating solution (5) for forming an image forming layer | Pigment dispersion solution (5) | Pigment dispersion solution (5) |
| Ex. I-6 | Coating solution (6) for forming an image forming layer | Pigment dispersion solution (2) | Pigment dispersion solution (1) |
| Ex. I-7 | Coating solution (7) for forming an image forming layer | Pigment dispersion solution (3) | Pigment dispersion solution (1) |
| Ex. I-8 | Coating solution (8) for forming an image forming layer | Pigment dispersion solution (4) | Pigment dispersion solution (1) |
| Ex. I-9 | Coating solution (9) for forming an image forming layer | Pigment dispersion solution (5) | Pigment dispersion solution (1) |

Ex.: Example according to the present invention

The following composition was blended while being stirred with a stirrer, so as to prepare a coating solution for a light-to-heat conversion layer.

(Composition of the Coating Solution for a Light-to-heat Conversion Layer)

Infrared ray absorbing dye 0.5 part
(NK-2015, made by Nihon Photosensitive dye Co., Ltd.)

Polyimide 9.1 parts
(RIKA COAT SN-20, made by Shin Nihon Chemical Co., Ltd.)

Fluorine-based surfactant 0.1 part
(MEGAFAC F-176PF manufactured by Dainippon Ink and chemicals Inc.)

n-Methyl -2 -pyrrolidone 41.5 parts

Methyl ethyl ketone 48.8 parts

Nine PET bases having a thickness of 75 $\mu$m were prepared, and then the coating solution for a light-to-heat conversion layer obtained as above was applied onto the respective PET bases by an extrusion-type applicator and was dried so as to have a dry thickness of 0.3 $\mu$m. This process gave 9 PET bases onto which the light-to-heat conversion layer was applied.

Next, the resultant respective coating solutions (1) to (9) for image forming layers were applied onto the respective light-to-heat conversion layer layers of the 9 PET bases onto which the respective light-to-heat conversion layer were applied, and then dried in the manner that the thickness of the resultant dried layer would be 0.3 μm, so as to obtain 9 sorts of laser thermal transfer materials (1) to (9) of the present invention, in which respective image forming layers were laminated on the respective light-to-heat conversion layers.

Preparation of a Thermal Transfer Image Receiving Material

A cushioning intermediate layer coating solution and an image receiving layer coating solution each having the following composition were prepared.

[Composition of the Cushioning Intermediate Layer Coating Solution]

Copolymer of vinyl chloride and vinyl acetate 15.1 parts (SOLBIN manufactured by Nissin Chemical Industry Co., Ltd.)

Plasticizer (adipic acid based polyester) 16.9 parts (PARAPLEX G40 manufactured by CP, HALL, company)

Fluorine-based surfactant 0.5 part (MEGAFAC F-178 manufactured by Dainippon Ink and chemicals Inc.)

Methyl ethyl ketone (solvent) 51.3 parts

Toluene 13.7 parts

N,N-dimethyl formamide 2.5 parts

[Composition of the Image Receiving Layer Coating Solution]

Polyvinyl butyral 7.9 parts (S-REC BL-SH manufactured by Sekisui Chemical Co., Ltd.)

Fluorine-base surfactant 0.1 part (MEGAFAC F-176PF manufactured by Dainippon Ink and Chemicals Inc.)

n-Propyl alcohol 22.8 parts

MFG 20.9 parts

Methanol 48.3 parts

The resulting cushioning intermediate layer coating solution was applied on an expanded PET base (trade name: LUMIRROR E68L, made by Toray Co., Ltd.) with an extrusion-type applicator and was dried in the manner that the thickness of the resultant dried layer would be 18 μm, so as to form a cushioning intermediate layer.

Next, the above-mentioned image receiving layer coating solution was applied onto the formed cushioning intermediate layer with the extrusion-type applicator and was dried in the manner that the thickness of the resultant dried layer would be 2 μm, so as to form an image receiving layer. Thus, the thermal transfer material (1) was obtained.

Image-recording

The thermal transfer image receiving material (1) (25 cm×35 cm) obtained as described above was wound around a rotation drum whose diameter was 25 cm and which had vacuum suction holes with a diameter of 1 mm formed thereon (at a surface density of one hole per area of 3 cm×3 cm). The laser thermal transfer image receiving layer was then suctioned. Then, the thermal transfer material (1) (30 cm×40 cm) was laminated to the thermal transfer image receiving material (1) such that the thermal transfer material (1) protruded out evenly at each side of the thermal transfer image receiving material (1). A laminate was formed by contacting the thermal transfer material (1) with the thermal transfer image receiving material (1) such that air was suctioned into the suction holes of the rotating drum while these materials were squeezed by a squeeze roller. The degree of pressure reduction when the suction holes were blocked was −150 mmHG/atm.

By the rotation of the above described drum, the surface of the laminate on the drum was irradiated from the side of the support of the laser thermal transfer material (1) with a semiconductor laser light having a wavelength of 830 nm (radiation energy on the support surface of the laser thermal transfer material: 300 mL/cm$^2$) by means of TC-P1080 (made by Dainippon Screen Mfg. Co., Ltd.) so as to converge the laser light onto the surface of the light-to-heat conversion layer. At this time, laser irradiation was performed by moving the laser light in a direction orthogonal (the sub-scanning direction) to a rotating direction of the drum (main-scanning direction) so that image was recorded imagewise.

When the laminate subjected to the laser image recording as described above was removed from the drum, and the laser thermal transfer material (1) and the thermal transfer image receiving material (1) of the present invention were peeled with each other, it was confirmed that portions of the image forming layer irradiated with the laser were transferred to the thermal transfer image receiving material (1) and good images were formed.

In the same way, images were formed on the respective laser thermal transfer materials (2) to (9), using the thermal transfer image receiving materials (1).

Evaluation of Transferability

About the laser thermal transfer materials (1) to (9) before laser radiation, optical reflection densities (r) of respective image forming lasers thereof were measured with a Macbeth reflection density meter (a blue filter). Furthermore, optical reflection densities (R) of images formed on the respective thermal transfer image receiving materials (1) after the above-mentioned thermal transfer and peeling were measured in the same way as above.

Each transfer ratio [(R/r)×100] resulting from the laser thermal transfer was calculated from each of the resultant r's and R's. The ratio was used as an index for exhibiting transfer performance. The obtained results are shown in Table 3 described below.

Evaluation of Image Hue

The hues of the resultant images were compared with hues of Japan standard color samples (version 2) with eyes, and the differences therebetween were subjected to functional evaluation in accordance with the following criterion. The results are shown in Table 3.

Criterion

○: The hue of the formed image was substantially the same as that of the standard color sample.

Δ: The hue of the formed image was somewhat different from that of the standard color sample, but was practically good.

X: The hue of the formed image was greatly different from that of the standard color sample.

Comparative Example I-1

Preparation of a Pigment Dispersion Solution (6)

A pigment dispersion solution (6) was prepared in a same manner as the pigment dispersion solution (1), except that the following compound F was used instead of the compound E used in the preparation of the pigment dispersion solution (1) in Example I-1.

The resultant pigment dispersion solution (6) was used as a pigment dispersion solution A and a pigment dispersion solution B, to prepare an image forming layer coating solution (10).

A laser thermal transfer material (10) was prepared in a same manner as in Example I-1 except that the image forming layer coating solution (10) obtained as described above was used instead of the image forming layer coating solution (1).

compound F

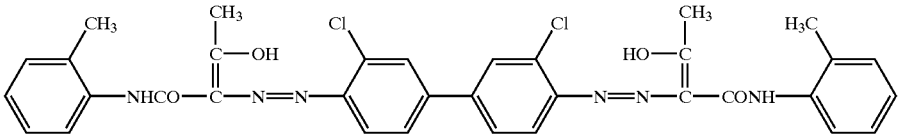

TABLE 2

| | Sort of a coating solution | Pigment dispersion solution A | Pigment dispersion solution B |
|---|---|---|---|
| C.E. I-1 | Image forming layer coating solution (10) | Pigment dispersion solution (6) | Pigment dispersion solution (6) |

C.E.*: Comparative Example

Using the same thermal transfer material (1) as used in Examples I-1 to I-9, recording was imagewise performed by laser radiation in the same way as in Examples I-1 to I-9 and then the thermal transfer material (1) was peeled to form an image on the thermal transfer image receiving material (1).

In the same as in Examples I-1 to I-9, transferability and the hue of the image were evaluated. The results are shown in Table 3.

TABLE 3

| | Transferability (%) | Hue of the image |
|---|---|---|
| Ex. I-1 | 99 | Δ |
| Ex. I-2 | 98 | Δ |
| Ex. I-3 | 99 | Δ |
| Ex. I-4 | 99 | Δ |
| Ex. I-5 | 99 | Δ |
| Ex. I-6 | 99 | ○ |
| Ex. I-7 | 99 | ○ |
| Ex. I-8 | 98 | ○ |
| Ex. I-9 | 98 | ○ |
| C.E. I-1 | 60 | Δ |

It can be understood from the results shown in Table 3 that according to the laser thermal transfer materials (1) to (5) of the present invention, which contained a pigment having in its structure an isoindoline ring or contained any one of the compounds A to E, the pigment decomposed thermally to a small extent, transferability upon thermal transfer was excellent and an image having a high image density and a good hue was obtained. According to the laser thermal transfer materials (6) to (9) of the present invention, which contained a pigment having an isoindoline ring together with any one of the compounds A to E, the pigments decomposed thermally to a small extent, transferability upon thermal transfer was excellent and a high density was obtained. At the same time, a vivid image having a better hue was able to be obtained.

On the other hand, according to the laser thermal transfer material (10) which contained neither pigment having an isoindoline ring nor pigments of the compounds A to D, the amount of the thermally decomposed pigment was large upon thermal transfer, and a sufficient transfer ratio was not able to be obtained. Therefore, the formed image had a very low image density and image defects based on transfer unevenness. Thus, an image having high quality was not able to be obtained.

Examples II-1

Production of a Laser Thermal Transfer Material

Using the compound A to prepare a pigment dispersion solution, a laser thermal transfer material (2) was obtained in a same manner as in Example I-2. An image was formed in the same way as in Examples I-1 to I-9, so that it was confirmed that the formed image was a good image.

About generated gas, harmful materials were examined with a gas chromatographic mass spectrometer (GC-MS), so that it was not confirmed that harmful materials ware generated by thermal decomposition of the compound A.

Evaluation of Transferability

Transferability was evaluated in the same way as in Examples I-1 to I-9. The results are shown in Table 4 described below.

Evaluation of Transfer Unevenness

Laser scanned lines of the resultant image was observed with eyes, and the transfer unevenness of the formed image was subjected to functional evaluation in accordance with the following criterion. The results from the evaluation are shown in Table 4.

Criterion

○: The densities throughout the scanned line were uniform to generate no transfer unevenness. The formed image had no density unevenness and was good.

X: Transfer unevenness was caused at the center of the scanned line and its transfer density was lower than that of both end portions of the scanned line. Thus, the formed image had remarkable density unevenness.

Comparative Example II-1

A laser thermal transfer material (11) was prepared in the same way as in Example II-1 except that the compound F was used instead of the compound A used in the preparation of the pigment dispersion solution of Example II-1.

Using the same thermal transfer material (1) as produced in Examples I-1 to I-9, recording was imagewise performed by laser radiation in the same way as in Examples I-1 to I-9 and then the thermal transfer material (1) was peeled to form an image on the thermal transfer image receiving material (1).

Upon the thermal transfer by laser radiation, the compound F used as a pigment decomposed thermally, so as to produce the following compound G (3,3'-dichlorobenzidine). The compound G was identified in the same was in Example II-1. This compound G was a harmful compound and was described, for example, on page 559 of Chemical Material Safety Data Book (edited by the society for the study of safety data on chemical materials, and published on Nov. 30, 1997 by Ohm Company).

In the same way as in Example II-1, transferability and transfer unevenness were evaluated. The results are shown in

TABLE 4 compound G

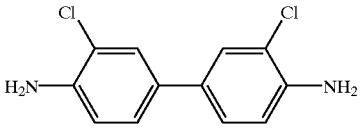

3,3'-dichlorobenzidine

| | Transfer ratio % | Transfer unevenness |
|---|---|---|
| Ex. II-1 | 98 | ○ |
| C.E. II-1 | 60 | × |

It can be understood from the results shown in Table 4 that according to the laser thermal transfer material (2) of the present invention, which contained as a coloring agent a pigment having a specific structure defined in the present invention, thermal decomposition was suppressed, transferability upon thermal transfer was excellent and a high-quality image having a small drop in image density and no image defects such as transfer unevenness was obtained. It is recognized from the transfer ratio in Table 4 that thermal decomposition of the pigment was a very small quantity. No harmful materials were produced.

On the other hand, according to the laser thermal transfer material (11), which contained a pigment which did not have any specific structure defined in the present invention, the pigment decomposed thermally upon thermal transfer so that a sufficient transfer ratio was not able to be obtained. Therefore, the formed image had a large drop in image density. Image defects were caused by transfer unevenness so that a high-quality image was not able to be formed.

What is claimed is:

1. A laser thermal transfer material comprising at least a light-to-heat conversion layer and an image forming layer on a support, said image forming layer comprising at least one compound selected from the group consisting of compounds represented by the following general formulas (1), (2), (4) and (5):

general formula (1)

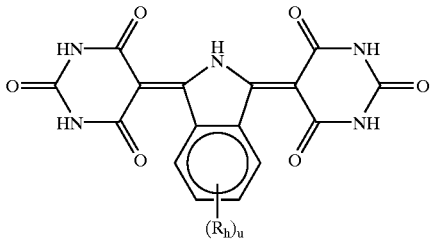

wherein Rh represents a hydrogen atom, an alkyl group having 1–5 carbon atoms, an alkoxy group having 1–5 carbon atoms, a halogen atom, a carboxylate ester group having an alkyl group having 1–5 carbon atoms, or an amide group having an alkyl group having 1–5 carbon atoms; u is an integer of 1–4; and if u is at least two, Rh's may be the same as or different from each other;

general formula (2)

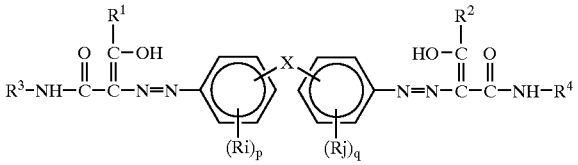

wherein $R^1$ and $R^2$ each independently represents an alkyl group having 1–5 carbon atoms or an alkoxy group having 1–5 carbon atoms; $R^3$ and $R^4$ each independently represents an aromatic group, or a condensed heterocyclic group wherein a heteroring is condensed with an aromatic ring; aromatic groups comprising Ri or Rj are connected to each other through a bivalent connecting group X; Ri and Rj each independently represents a hydrogen atom, an alkyl group having 1–5 carbon atoms, an alkoxy group having 1–5 carbon atoms, or a halogen atom; p and q each independently represents an integer of 1–4; and if p or q is at least 2, Ri's and Rj's may be the same as or different from each other;

general formula (4)

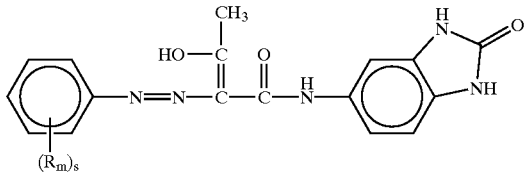

wherein Rm represents an alkoxylcarbonyl group having 2–5 carbon atoms, an alkyl group having 1–5 carbon atoms or an alkoxy group having 1–5 carbon atoms; s is an integer of 1–5; and if s is at least two, Rm's may be the same as or different from each other;

general formula (5)

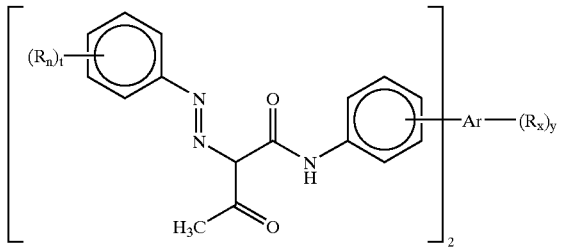

wherein Ar represents an arylene group; Rn represents a hydrogen atom, an alkoxylcarbonyl group having 2–5 carbon atoms, an alkyl group having 1–5 carbon atoms or an alkoxy group having 1–5 carbon atom; t is an integer of 1–5; Rx represents an hydrogen atom, an alkyl group having 1–5 carbon atoms or an alkoxy group having 1–5 carbon atoms; y is an integer of 1–4; and if t or y is at least 2, Rn's or Rx's may be the same as or different from each other.

2. The material according to claim 1, wherein said compound is selected from compounds having an isoindoline ring represented by general formula (I).

3. The material according to claim 1, wherein said compound is selected from disazo compounds represented by general formula (2).

4. The material according to claim 3, wherein $R^3$ and $R^4$ each independently represents benzoimidazolone ring group represented by the following structural formula (a):

structural formula (a)

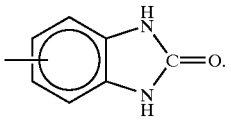

5. The material according to claim 3, wherein $R^1$ and $R^2$ each independently represents an alkyl group having 1–4 carbon atoms or an alkoxy group having 1–4 carbon atoms.

6. The material according to claim 5, wherein $R^3$ and $R^4$ each independently represents benzoimidazolone ring group represented by the following structural formula (a):

structural formula (a)

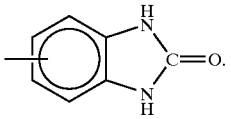

7. The material according to claim 6, wherein said compound represented by the general formula (2) is a yellow pigment.

8. The material according to claim 5, wherein said compound represented by the general formula (2) is a yellow pigment.

9. The material according to claim 5, wherein the material is used in a thermal transfer image receiving material, and said laser thermal transfer material further comprises at least an image receiving layer and a cushion layer on said support.

10. The material according to claim 5, further comprising a cushion layer between said support and said light-to-heat conversion layer.

11. The material according to claim 1, wherein said compound is selected from monoazos compounds having benzoimidazolone, which are represented by general formula (4).

12. The material according to claim 1, wherein said compound is selected from condensed azo compounds represented by general formula (5).

13. A laser thermal transfer material comprising at least a light-to-heat conversion layer and an image forming layer on a support, said image forming layer comprising a compound having an isoindoline ring, which is represented by the following general formula (1), and at least one compound selected from the group consisting of compounds represented by the following general formulas (2) to (5):

general formula (1)

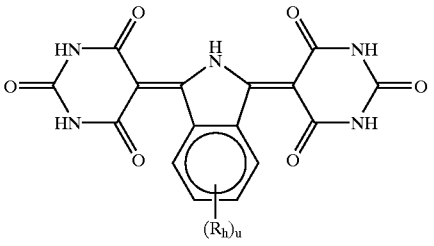

wherein Rh represents a hydrogen atom, an alkyl group having 1–5 carbon atoms, an alkoxy group having 1–5 carbon atoms, a halogen atom, a carboxylate ester group having an alkyl group having 1–5 carbon atoms, or an amide group having an alkyl group having 1–5 carbon atoms; u is an integer of 1–4; and if u is at least two, Rh's may be the same as or different from each other;

general formula (2)

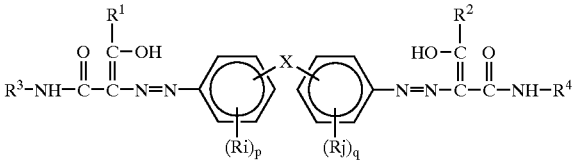

wherein $R^1$ and $R^2$ each independently represents an alkyl group having 1–5 carbon atoms or an alkoxy group having 1–5 carbon atoms; $R^3$ and $R^4$ each independently represents an aromatic group, or condensed heterocyclic group wherein a heteroring is condensed with an aromatic ring; aromatic groups comprising Ri or Rj are connected to each other through a bivalent connecting group X; Ri and Rj each independently represents a hydrogen atom, an alkyl group having 1–5 carbon atoms, an alkoxy group having 1–5 carbon atoms, or a halogen atom; p and q each independently represents an integer of 1–4; and if p or q is at least 2, Ri's and Rj's may be the same as or different from each other;

general formula (3)

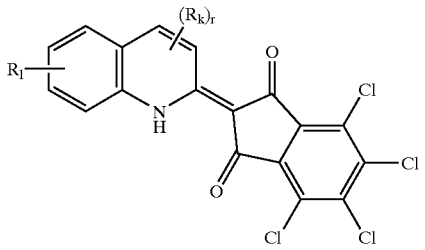

wherein Rk represents a hydrogen atom, an alkyl group having 1–5 carbon atoms or an alkoxy group having 1–5 carbon atoms; r is an integer of 1 or 2; if r is 2, Rk's may be the same or different from each other; and Rl represents a tetrachlorophthaloimide group represented by the following structural formula (b):

structural formula (b)

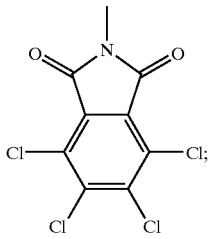

general formula (4)

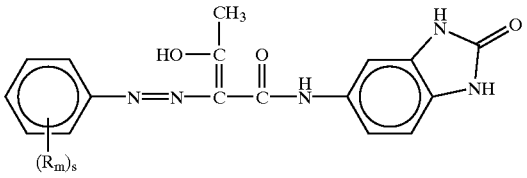

wherein Rm represents an alkoxylcarbonyl group having 2–5 carbon atoms, an alkyl group having 1–5 carbon atoms or an alkoxy group having 1–5 carbon atoms; s is an integer of 1–5; and if s is at least two, Rm's may be the same as or different from each other;

general formula (5)

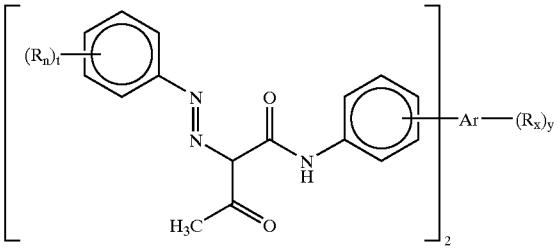

wherein Ar represents an arylene group; Rn represents a hydrogen atom, an alkoxylcarbonyl group having 2–5 carbon atoms, an alkyl group having 1–5 carbon atoms or an alkoxy group having 1–5 carbon atoms; t is an integer of 1–5; Rx represents an hydrogen atom, an alkyl group having 1–5 carbon atoms or an alkoxy group having 1–5 carbon atoms; y is an integer of 1–4; and if t or y is at least 2, Rn's or Rx's may be the same as or different from each other.

14. The material according to claim 13, wherein $R^3$ and $R^4$ each independently represents benzoimidazolone ring group represented by the following structural formula (a):

structural formula (a)

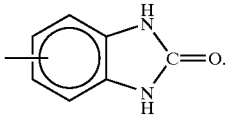

15. The material according to claim 14, wherein the weight ratio of the content (X) of said compound having the isoindoline ring, which is represented by the general formula (1) to the total content (Y) of at least one of said compounds selected from said group consisting of compounds represented by the general formulas (2) to (5), in said image forming layer, is from 1:99 to 30:70.

16. The material according to claim 13, wherein the weight ratio of the content (X) of said compound having the isoindoline ring, which is represented by the general formula (1) to the total content (Y) of at least one of said compounds selected from said group consisting of compounds represented by the general formulas (2) to (5), in said image forming layer, is from 1:99 to 30:70.

* * * * *